US005471219A

United States Patent [19]

Rodeffer et al.

[11] Patent Number: 5,471,219

[45] **Date of Patent: * Nov. 28, 1995**

[54] METHOD FOR AUTOMATICALLY POSITIONING A SATELLITE DISH ANTENNA TO SATELLITES IN A GEOSYNCHRONOUS BELT

[75] Inventors: Charles E. Rodeffer, Burlington, Iowa; John D. Byers, Arvada, Colo.; Michael E. Rodeffer, Burlington, Iowa

[73] Assignee: Winegard Company, Burlington, Iowa

[ * ] Notice: The portion of the term of this patent subsequent to Mar. 22, 2011, has been disclaimed.

[21] Appl. No.: 210,160

[22] Filed: Mar. 17, 1994

Related U.S. Application Data

[63] Continuation of Ser. No. 978,289, Nov. 18, 1992, Pat. No. 5,296,862.

[51] Int. Cl.[6] ..... H01Q 3/00

[52] U.S. Cl. ..... 342/359; 343/757

[58] Field of Search ..... 342/359, 426, 342/75, 76, 352; 343/757

[56] References Cited

U.S. PATENT DOCUMENTS

| | | | |
|---|---|---|---|
| 4,743,909 | 5/1988 | Nakamura | 342/359 |
| 4,783,848 | 11/1988 | Ma et al. | 455/182 |
| 4,801,940 | 1/1989 | Ma et al. | 342/359 |
| 4,888,592 | 12/1989 | Paik et al. | 342/359 |
| 4,907,003 | 3/1990 | Marshal et al. | 342/352 |
| 5,077,560 | 12/1991 | Horton et al. | 342/359 |

OTHER PUBLICATIONS

Best Made advertisement–circa 1991.
Moto–Sat, Elkhart Satellite Systems–circa 1991.
"Cover The Miles With Moto–Sat", Elkhart Satellite Systems–circa 1991.
Moto–Sat, Elkhart Satellite Systems–circa 1991.
Travel–Sat, operation instructions–circa 1991.
Travel–Sat, operation manual–circa 1991.
The Retriever, owner's mamual & operating instructions–circa 1991.
Travel–Sat, installation manual–circa 1991.

*Primary Examiner*—Gregory C. Issing
*Attorney, Agent, or Firm*—Dorr, Carson, Sloan & Birney

[57] ABSTRACT

A receiver connected to the satellite dish antenna receives signals from an electronic compass for generating a magnetic direction signal. The approximate latitude and longitude values of the parked vehicle are displayed and the user of the system manually selects the latitude and longitude coordinates corresponding to the parked vehicle location. The receiver determines an initial search position for the satellite dish antenna based upon the magnetic reading and the entered latitude and longitude values. The satellite dish antenna is moved from an unstowed position to an initial search position. The satellite dish antenna is then moved in a first rectangular spiral search pattern to obtain a rough-tune position corresponding to the detection of a signal peak for a selected audio subcarrier frequency in a selected channel of a target satellite. The frequency selected is not present in corresponding selected channels of satellites near the target satellite. A fine-tune search is then performed and the method calculates all the azimuth and elevation positions of all remaining satellites.

25 Claims, 17 Drawing Sheets

Fig. 4

SET TARGET POSITIONS (400)

1 CITY = BURLINGTON , IA (410)
2 RV LATITUDE = 42.10 (420)
3 RV LONGITUDE = 90.10 (430)
4 COMPASS OVERIDE = ON (440)
5 COMPASS HEADING = 15 (450)
6 CHANGE SEARCH CHARACTERISTIC
SEARCH SAT. = ANIK E2
SEARCH CHAN = 6 (460)
SEARCH FREQ. = 5410
7 CALCULATE NEW SAT POSITIONS.
8 CALCULATE POLARITIES. = YES
9 SEARCH FOR SATELLITE

Fig. 5

CITY MENU (500)

| CITY | ST | LAT | LON |
|---|---|---|---|
| TAMPA | FL | 28.0 | 82.50 |
| ATLANTA | GA | 33.60 | 84.40 |
| SAVANNA | GA | 32.10 | 81.20 |
| BURLINGTON | IA | 41.80 | 91.10 |
| SIOUX CITY | IA | 42.40 | 96.40 |
| BOISE | ID | 43.60 | 116.20 |
| CHICAGO | IL | 42.0 | |

(510)

PRESS SELECT TO USE THE HIGHLIGHTED CITY.
PRESS QUIT TO EXIT MENU.

Fig. 6

SEARCH MENU (600)

| SATELLITE | CHANNEL | AUDIO |
|---|---|---|
| ANIK E2 | 6 | 5410 |
| ANIK E2 | 1 | 7800 |
| GALAXY | 13 | 5760 |
| TELS 301 | 3 | 5800 |
| GALAXY 1 | 3 | 6480 |
| SPACENET 1 | 17 | 7560 |
| GALAXY 3 | 24 | 5400 |
| SPACENET 3 | 9 | 5940 |
| SATCOM 4 | 15 | 5800 |
| SPACNET 2 | 23 | 5800 |
| ANIK E2 | 23 | 5410 |
| ANIK D2 | 15 | 5940 |

(610)

PRESS HELP FOR HELP

Fig. 11(a)
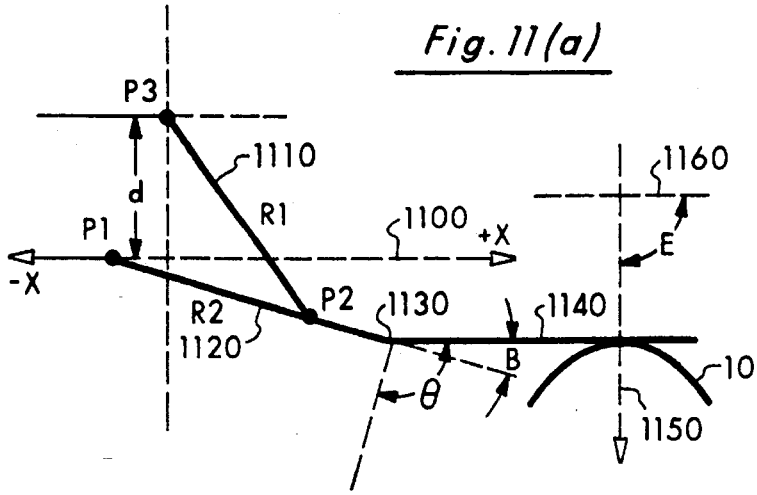
Fig. 11(b)
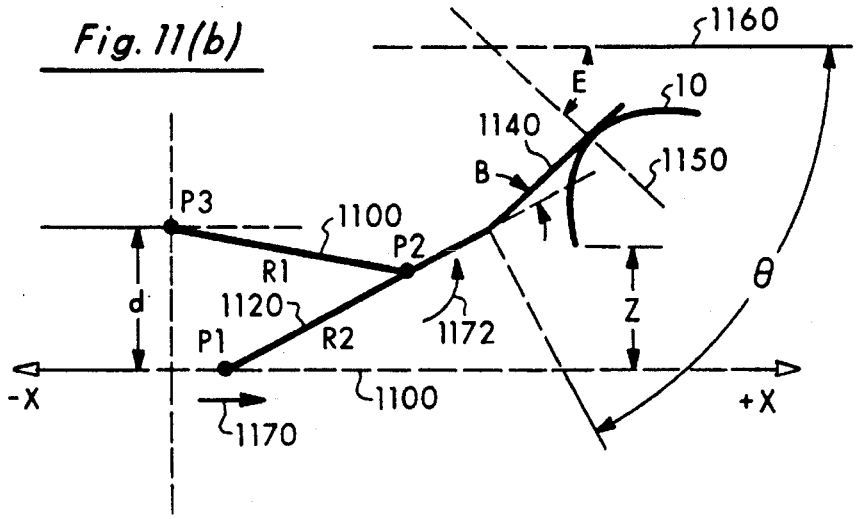
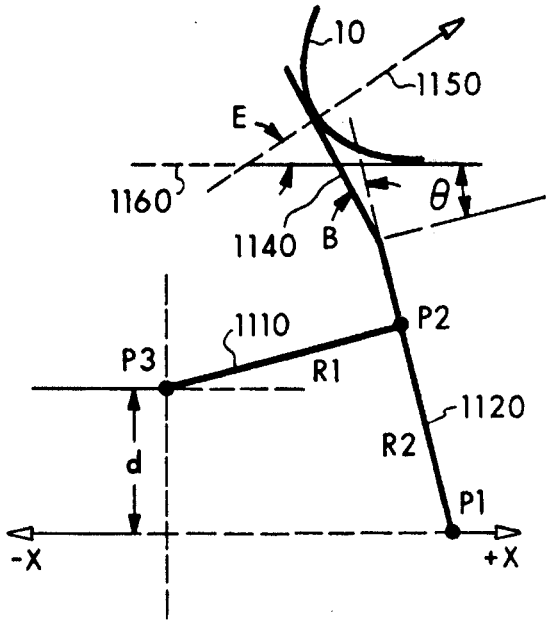
Fig. 11(c)

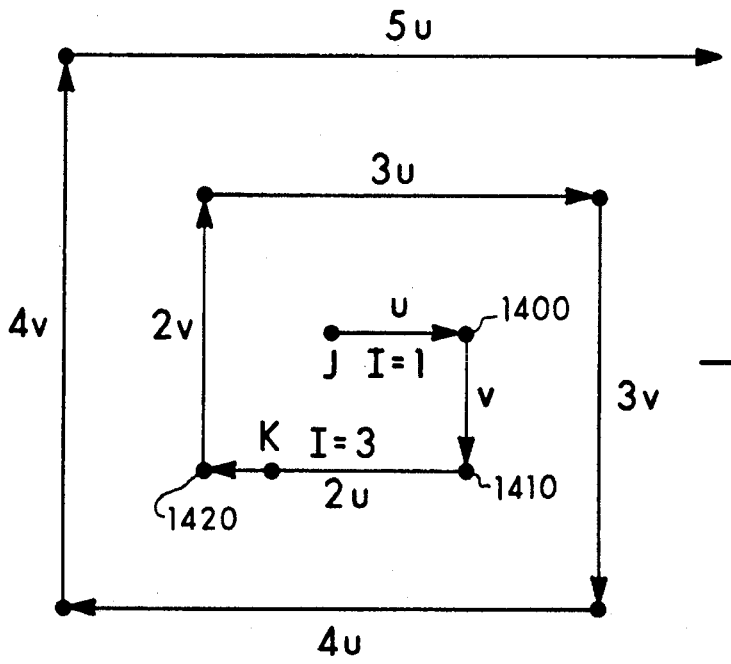
Fig. 14
Fig. 17
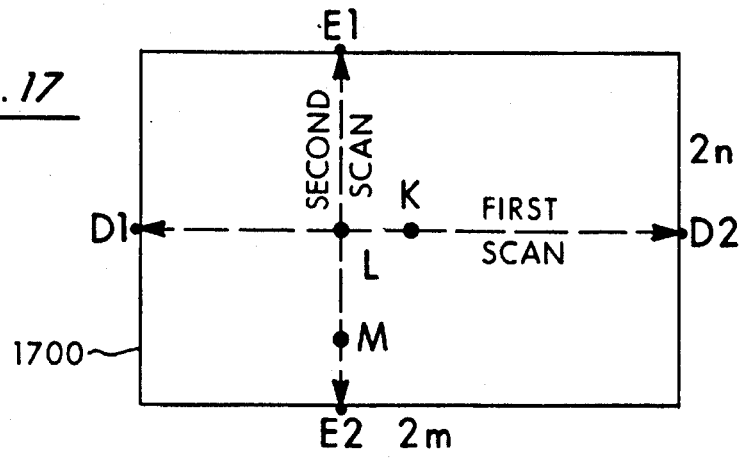
Fig. 19
SEARCH PARAMETER MENU
--> AZ SPIRAL (CNTS) = 60
EL SPIRAL (CNTS) = 90
SCAN STEPS = 14
SAMPLES INC./STEP = 12
AZ FINE WNDW (CNTS) = 50
AZ FINE SAMPLES = 100
AZ FINE WNDW (CNTS) = 75
EL FINE SAMPLES = 150
AZ CNTS/DEGREE = 10
AZ FOUND (DEGREES) = 1.0
AZ RANGE (DEGREES) = 5.0
EL CNTS/DEGREE = 15
EL FOUND (DEGREES) = 1.0
EL RANGE (DEGREES) = 5.0
SIGNAL THRESHOLD = 3

EXECUTE SEARCH
760
START
1500
I = 1
1510
MOVE DISH ALONG SCAN STEP 1.
1514
TAKE DATA READING?
1518
Yes
No
READ & STORE SIGNAL STRENGTH
1520
END OF SCAN STEP?
1524
Yes
No
STOP ANTENNA MOVEMENT
1528
PROCESS DATA TAKEN DURING SCAN
1530
SATELLITE FOUND?
1534
Yes
No
MOVE DISH TO SATELLITE
1544
FINE TUNE DISH LOCATION
1550
FINE TUNE WORKED?
1560
Yes
No
SATELLITE FOUND
1570
INCREMENT I
1538
I > SCAN STEPS ALLOWED ?
1540
Yes
No
SATELLITE NOT FOUND
END

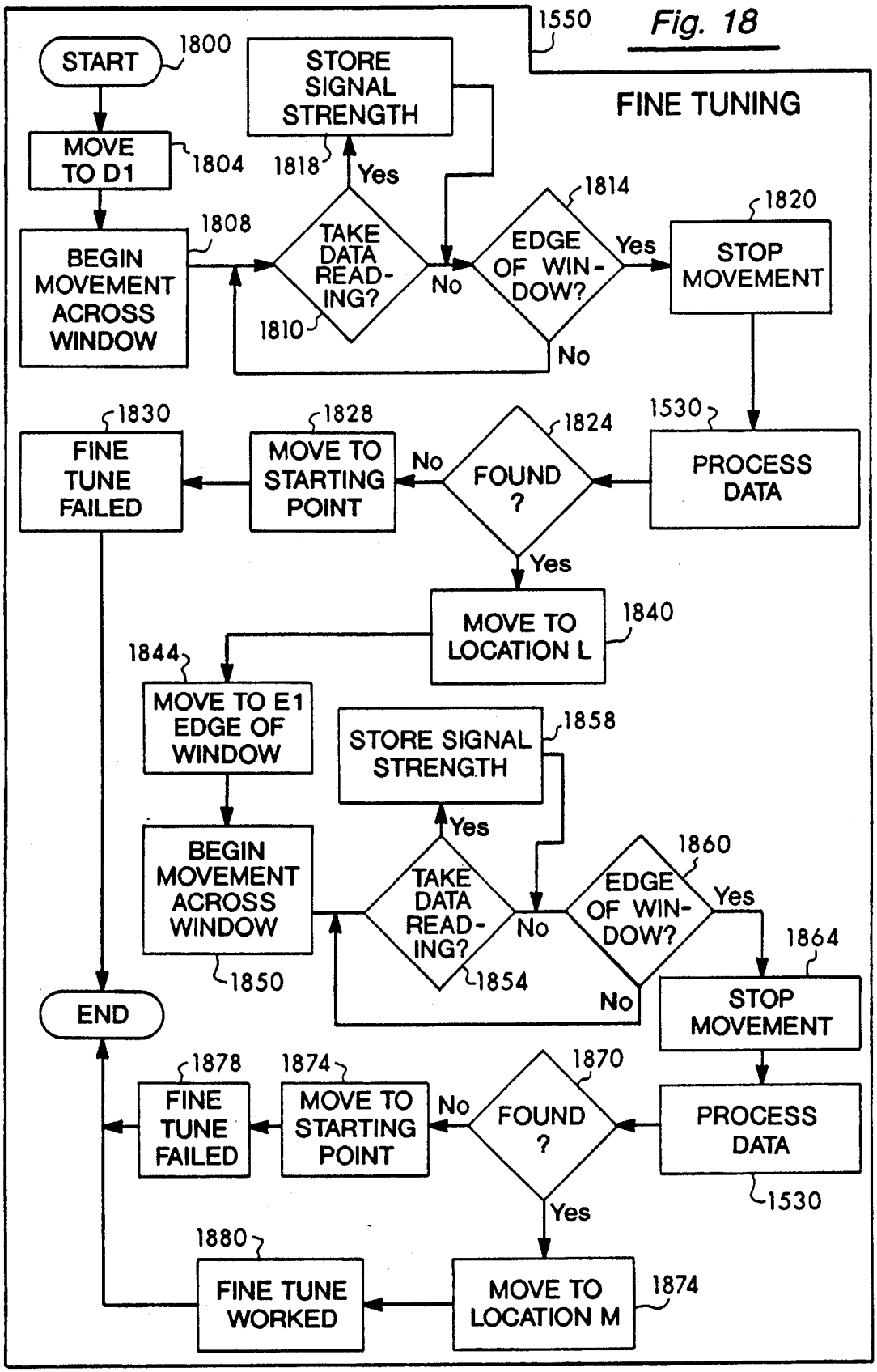
Fig. 18
1550
FINE TUNING
START
1800
MOVE TO D1
1804
BEGIN MOVEMENT ACROSS WINDOW
1808
STORE SIGNAL STRENGTH
1818
Yes
TAKE DATA READ-ING?
1810
No
EDGE OF WIN-DOW?
1814
Yes
No
STOP MOVEMENT
1820
PROCESS DATA
1530
FOUND ?
1824
No
Yes
MOVE TO STARTING POINT
1828
FINE TUNE FAILED
1830
MOVE TO LOCATION L
1840
MOVE TO E1 EDGE OF WINDOW
1844
BEGIN MOVEMENT ACROSS WINDOW
1850
STORE SIGNAL STRENGTH
1858
Yes
TAKE DATA READ-ING?
1854
No
EDGE OF WIN-DOW?
1860
Yes
No
STOP MOVEMENT
1864
PROCESS DATA
1530
FOUND ?
1870
No
Yes
MOVE TO STARTING POINT
1874
FINE TUNE FAILED
1878
END
MOVE TO LOCATION M
1874
FINE TUNE WORKED
1880

METHOD FOR AUTOMATICALLY POSITIONING A SATELLITE DISH ANTENNA TO SATELLITES IN A GEOSYNCHRONOUS BELT

This is a continuation of application Ser. No. 07/978,289 filed on Nov. 18, 1992 now U.S. Pat. No. 5,296,862.

BACKGROUND OF THE INVENTION

1. Copyright Waiver

A portion of the disclosure of this patent document contains material which is subject to copyright protection. The copyright owner has no objection to the facsimile reproduction by any one of the patent disclosure, as it appears in the Patent and Trademark Office patent files or records, but otherwise reserves all copyright rights whatsoever.

2. Related Invention

"Deployable Satellite Dish Antenna For Use on Vehicles", Ser. No. 08/265,392, filed on Jun. 24, 1994.

FIELD OF THE INVENTION

The present invention relates to TVRO satellite dish antennas and, more particularly, to methods for automatically positioning a TVRO satellite dish antenna mounted on a vehicle such as a recreational vehicle to locate satellites in the geosynchronous Clarke belt.

Statement of the Problem

Over the past decade, TVRO antennas have grown substantially in popularity and are typically found in geographical areas of the United States where cable or broadcast television is not prevalent. Substantial programming exists on a number of satellites positioned in the Clarke belt, usually offering high quality programming through a paid descrambling system.

The advent of such commercially available programming from these satellites has found growing popularity among recreational vehicle users who would like to tap into this programming during their trips around the country in recreational vehicles. Initial satellite TVRO systems for recreational vehicles were simply comprised of a small TVRO dish antenna placed on the ground near the RV which was then manually adjusted with great care and time to locate and tune into an individual satellite. The tuning process would be repeated for tuning into another satellite. This approach was somewhat effective but resulted in considerable set up time by the consumer and usually resulted in low quality signals in the television set.

some satellite dish antennas are designed to mount directly on the roof of the recreational vehicle. This eliminates the need for placement and storage of the satellite dish antenna such as described above. However, the alignment of the mounted satellite dish antenna to the satellite was still difficult due to the manual adjustments involved. An example of this type of conventionally available system is manufactured by RV Satellite Systems, 2356 South Sara Street, Fresno, Calif. 93706 under the trademark "BEST MADE". This antenna is designed to be raised and lowered from inside the RV and to be easily tuned into the satellite desired. The raising, lowering and positioning of the dish antenna is manual based upon a mechanical link between the inside and outside of the RV.

A goal of TVRO satellite systems for use on RVs has been to fully automate the set-up and tuning of the dish antenna to all of the satellites. One conventionally available system providing semi-automatic set-up is manufactured by Elkhart Satellite systems, 23663 U.S. Highway 33, Elkhart, Ind., 46517 which carries the trademark "MOTO-SAT". This system utilizes an electronic compass.

Another conventional RV satellite dish antenna providing semi-automatic positioning is manufactured by The Dometic Corporation, 609 South Poplar Street, LaGrange, Ind. 46716. This system is manufactured under the trademark "A&E TRAVEL-SAT". The satellite dish antenna is mounted to the roof of the RV. When the RV is parked at a location such as a campsite, the RV is leveled and stabilized. The operator of the system uses a compass located at least six feet in front of the coach to ascertain the present compass heading of the coach (and therefore, of the antenna). The user turns on the receiver and the TV. The TV is set to a predetermined channel. The user then keys in the present compass heading into the system controller. The user refers to a "viewer's guide" to find the azimuth and elevation readings of the city nearest the campsite where the RV is parked. These coordinates correspond to the G1 satellite and are entered into the system controller by the user. The user presses the "aim" button on the system controller and the dish commences to move. As the dish moves, the user must closely watch the TV screen and, upon seeing a quick flash of an image across the screen, press the stop button on the controller. The user then presses "left" and "right" and "up" and "down" buttons to fine tune the satellite dish into the image. After finding a particular satellite, it must be identified so that the other satellites can be found. While this system provides an improvement over the earlier manual alignment approaches, it still involves substantial user interaction and time. It also requires the user's perception to watch for the images on the TV screen. The RETRIEVER™ system made by Vicor Industries, Inc. of Mission Viejo, Calif. 92690 follows a similar approach to the above.

Results of a Patentability Search

A patentability search was conducted pertaining to the features of the present invention. The search uncovered the following pertinent patents:

| PAT. NO. | INVENTOR |
|---|---|
| 4,801,940 | Ma et al. |
| 5,077,560 | Horton et al. |

U.S. Pat. No. 4,801,940 sets forth a satellite-seeking system for earth station antennas for TVRO systems. The '940 system utilizes the center frequencies for each of the transponders of a given satellite. Each channel of a transponder has a transponder center frequency, a first IF center frequency, a VCO output frequency, and a second IF center frequency. The TVRO antenna is mounted through a swivel mechanism which controls the azimuth of the antenna under control of a first motor. A second electric motor is utilized to control the degree of slant or elevation of the antenna. This type of mount is generally referred to as a "polar mount" and requires that the support rod of the antenna be aligned along a true North-by-South line. The antenna must be initially positioned manually in the general direction of the Clarke belt. Once the initial positioning has occurred, the system is capable of automatically positioning the satellite dish antenna through three levels of "seek". The system undertakes a resolution level 2 seek for a satellite by using a square wave search pattern within a predetermined rectangular area—moving first in elevation increments and then in azimuth increments. At each incremental position, the satellite is stopped and all of the twenty-four possible channels from a satellite receivable within the search area are rapidly scanned at all polarization angles. A comparison is made at each position to determine the lowest noise figure from all channels at all polarization angles. This measurement is then compared with the set of measurements at the next incremental position. The goal of this square wave search pattern in a rectangular area is to lock onto any discernible video indicating the presence of a satellite. Ma utilizes a two cycle square wave to search the rectangular area. This system utilizes the human operator to manually push a control button widen the operator sees an image on the receive monitor or utilizes a built-in artificial intelligence type of pattern recognition system which recognizes the presence of the video image on the screen. Hence, either the human operator or the artificial pattern recognition system will interrupt this level of search so that the system can enter a high resolution searching pattern. If in the level 2 seek, a signal is not obtained for a satellite, a level 3 seek is entered. In level 3, the rectangular search area is left and the system proceeds to the next rectangular search area to reconduct a level 2 seek. The subsequent rectangular search areas form an outwardly spiral pattern which is followed by the system until a satellite is detected. The '940 system, upon detecting a satellite in a level 2 seek, utilizes a fine resolution level 1 seek to determine the precise position of the antenna dish for optimum reception of the signals. In the high resolution level 1 seek, the position of the antenna from the level 2 seek forms the middle of a rectangular window of search. The search commences at one side of the rectangular window and again proceeds in a square wave searching pattern until it reaches the other end of the rectangular window. In the level 1 seek, half degree incremental steps in both the azimuth and elevation directions are utilized. A search is conducted throughout the entire rectangular area with a number of points being interrogated. The position representing the lowest noise figure is the optimum position for the satellite antenna for the satellite detected. Again, all channels of the given satellite are tested. Upon locating the optimum position, the number of pulses that each of the motors are displaced is recorded so that the antenna can be automatically repositioned to the same satellite. At this point, the satellite detected must be identified by manually watching the programming. The location of the remaining satellites can then be calculated from their relationship to this detected satellite. If needed, fine tuning of the antenna can be performed at each new satellite position. This approach requires manual intervention or the use of sophisticated artificial intelligence hardware to detect the presence of an image on a screen as well as operator identification of the detected satellite. Furthermore, this system requires the initial positioning of the satellite dish antenna and therefore is most ideal for fixed based TVRO satellite dishes.

The automatic drive system set forth in U.S. Pat. No. 5,077,560 also is utilized in a stationary TVRO mount. It is designed to reduce the skill level of installers of such TVRO systems by providing semi-automatic positioning. The '560 system uses an azimuth drive motor and an elevation drive motor. The receiver in the system has the capability of calculating and initially pointing the antenna dish at each of the satellites. The operator manually adjusts the satellite in the azimuth and elevation directions to maximize signal strength.

A need exists for a system for positioning a satellite dish antenna for use on recreational vehicles which automatically locates a known target satellite without user intervention. Upon locating the target satellite, all of the other satellites in the Clarke belt can be quickly located.

Solution of the Problem

The present invention provides a solution to the above problem by providing a system for automatically positioning a satellite dish antenna mounted on a recreational vehicle. This is accomplished by seeking and tuning to a unique audio subcarrier frequency of a channel which is a different subcarrier frequency than found in the corresponding channels of nearby satellites.

The present invention, therefore, is capable of easy installation and automatic operation by the user. The user does not need to know true North or the location of the Clarke Belt. The user does not need to know the actual latitude and longitude, since the user can select from a computer menu.

The present invention pertains to a method for positioning a satellite dish antenna mounted on a parked vehicle in order to receive signals from a plurality of satellites located in a geosynchronous belt. A receiver is connected to receive signals from the satellite dish antenna. The electronic compass is automatically read and the direction signal is delivered to the receiver. The user of the system manually enters the approximate latitude and longitude values of the parked vehicle into the receiver. The receiver determines an initial first position for the satellite dish antenna based upon the magnetic direction signal and the entered longitude and latitude values. The receiver then moves the satellite dish antenna in the azimuth and elevation directions to the initial search position. The satellite dish antenna is then moved in a first predetermined search pattern until obtaining a rough-tune position corresponding to the detection by the receiver of a first signal peak for a selected audio subcarrier frequency in a selected channel for a target satellite located in the geosynchronous belt. Under the teachings of the present invention, the selected audio subcarrier frequency is unique in that the frequency of the selected audio subcarrier is not present in channels of satellites adjacent to the target satellite. The receiver then moves the satellite dish antenna incrementally in a second predetermined search pattern to fine-tune the targeted signal. Upon the detection of a second signal peak for the selected audio subcarrier frequency, the satellite dish antenna is then determined to be in the proper orientation for receiving signals. The receiver then calculates the azimuth and elevation positions of all remaining satellites in the geosynchronous belt.

Additionally, once the fine-tune position is determined, this value becomes the value for the initial search position. This important feature significantly reduces future search time whenever the antenna is re-stowed on the top of the vehicle. This is true as long as the vehicle remains parked at the same location.

Another feature of the present invention is to lift the antenna upwardly from the roof of the vehicle a predetermined distance before rotating the antenna so as not to hit any other objects on the roof.

BRIEF DESCRIPTION OF THE DRAWING

FIG. 4 sets forth the target menu of the present invention.

FIG. 5 sets forth the city menu of the present invention.

FIG. 6 sets forth the search menu of the present invention.

FIG. 11 sets forth the geometric relationships through which the antenna of the present invention undergoes as it opens from a clasped position to the detection of the target satellite.

FIG. 14 sets forth the rectangular spiral gross search pattern of the present invention.

FIG. 17 sets forth the fine tune search pattern.

FIG. 18 sets forth the fine tuning flow chart.

FIG. 19 sets forth the search parameter menu.

DETAILED DESCRIPTION

Overview

Figure 1:
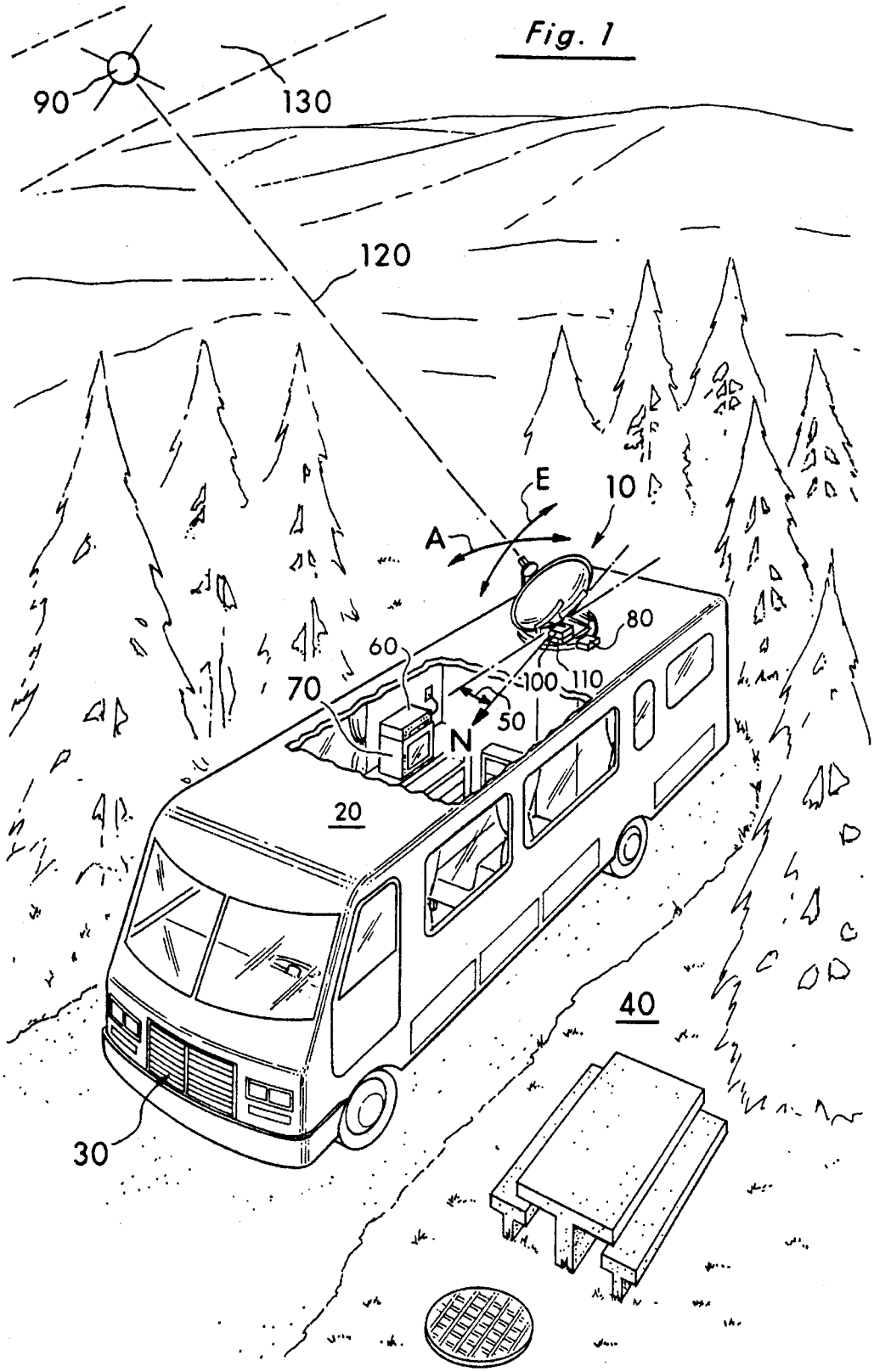
FIG. 1 is a perspective view of the TVRO system adapted for use on a recreational vehicle.

In FIG. 1, the satellite dish antenna 10 of the present invention is mounted to the roof 20 of a recreational vehicle 30 which is parked at a campsite 40. The vehicle 30 is oriented in a direction which is displaced from true North by an angular direction θ indicated by arrows 50. The antenna is connected to a receiver 60 which in turn is connected to a television 70. While the present invention finds application for use on any vehicle, in the preferred embodiment the vehicle is a recreational vehicle (RV), and the following disclosure will only refer to use on an RV. However, the scope of the invention is not to be limited to use on an RV. In fact, the present invention could be mounted on a building, but the invention is most suitably useful on vehicles that move from location to location. Hence, the term "vehicle" is used to mean any "carrier" that can move from location to location so as to have different longitudes and latitudes. The term "object" would include a carrier and a fixed support such as a building.

In operation, the satellite dish antenna 10 is folded in a downward position while the RV 30 is moving to the campsite 40. When the RV is parked at the campsite 40, the user activates the receiver 60 and the dish antenna 10 unfolds. The user inputs the city location into the receiver 60 based upon a city menu appearing on TV 70. The inputting of the city location by the user provides the latitude and longitude to the receiver 60. A magnetic compass 80 mounted on the mount of the satellite dish antenna 10 is automatically read by the receiver to provide angular deviation data θ from true North (i.e., termed a "direction signal"). Based on the manually entered latitude and longitude values and the generated electronic compass reading 80, the satellite dish antenna 10 is automatically moved in the azimuth elevation direction to the general direction of a target satellite 90 (i.e., the initial search position).

The satellite dish antenna 10 under control of the receiver 60 changes elevation E under control of an elevation motor 100 and changes azimuth direction A under control of an azimuth motor 110. This type of mount is conventional and is well known in the industry as an azimuth/elevation (AZ-EL) type of mount. With the satellite dish antenna in the initial search position, a predetermined rough-tune search pattern is first used by receiver 60 to ascertain the presence of a first peak signal from a selected audio subcarrier frequency (i.e., 5.14 MHz) appearing in a selected channel (i.e., Ch 6) of the target satellite 90 (i.e., ANIK-E2). If a first peak signal is found in the rough-tune search, a fine tune search pattern is then used by receiver 60 to precisely locate a second peak signal for the selected audio subcarrier. The satellite dish antenna 10 is now properly positioned along bore sight 120 to receive signals from the target satellite 90. At this time, the target satellite 90 is identified and the locations (i.e., azimuth and elevation positions) of all of the other satellites in the Clarke belt 130 can be precisely located by the receiver 60.

The user interacts with the system only to turn the receiver on and to enter the location through a menu select. Otherwise, the receiver of the present invention, based upon the entered location and the compass reading, automatically. 1) unfolds the antenna to an approximate bore-sight for a selected satellite based upon the location and compass reading, 2) performs the rough-tune search which roughly locates the bore-sight of the antenna to a selected audio sub-carrier signal, and 3) performs the fine-tune search which precisely locates the bore-sight of the antenna to receive the audio signal.

The system of the present invention is designed to be extremely "user-friendly" in locating satellites in the geosynchronous Clarke belt. As discussed next, the user simply parks the RV, enters the approximate Latitude and longitude, and the system will automatically find a preprogrammed target satellite. Once the target satellite has been found, all of the other satellite locations are automatically calculated.

Receiver 60

Figure 2:
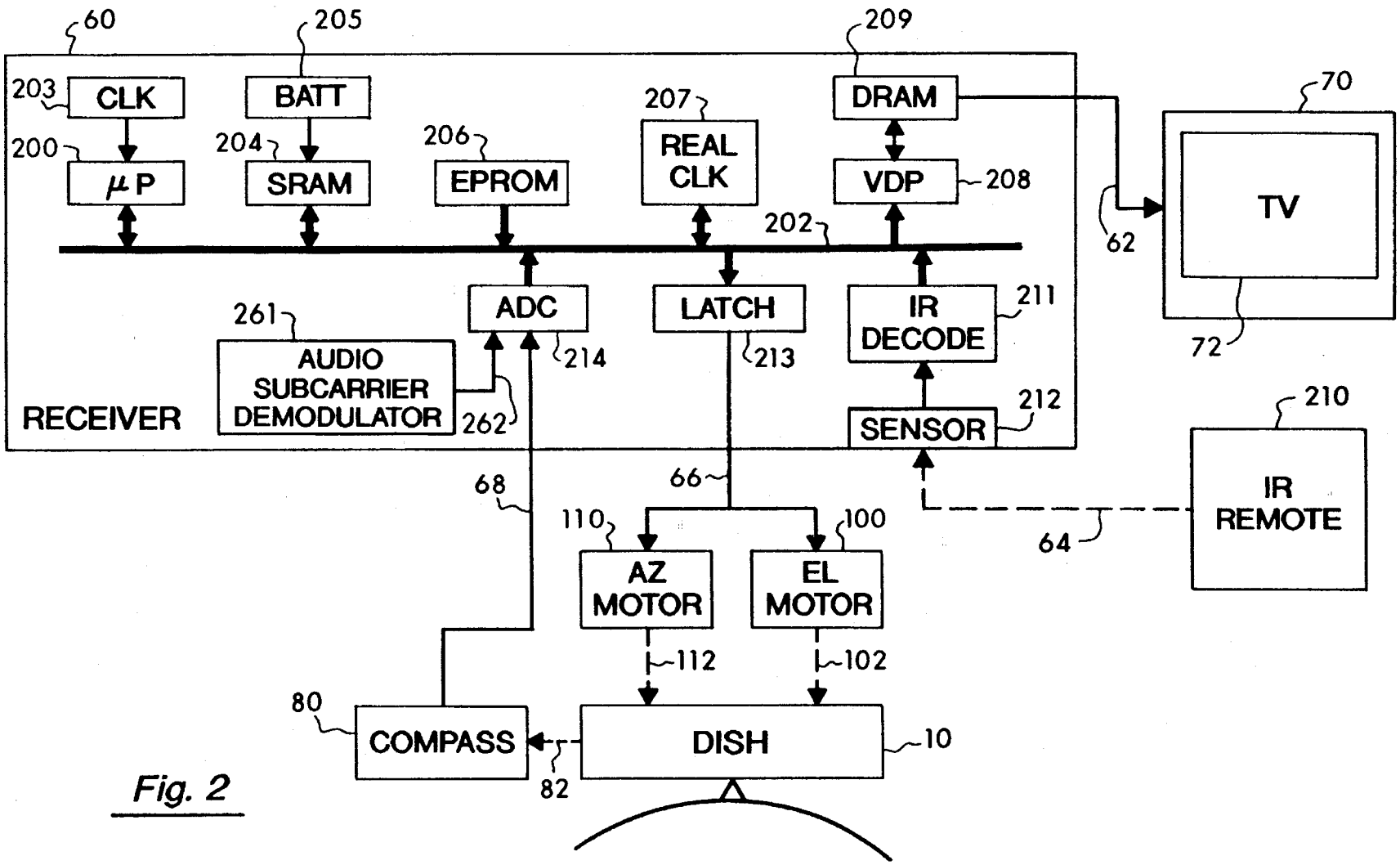
FIG. 2 is a block diagram of the electronic and electrical components of the present invention.

In addition to having the standard electronic circuitry for TVRO tuning and reception including the descrambling circuitry, the receiver 60 of the present invention, as shown in FIG. 2, includes a microprocessor 200 and associated digital electronics described in the following.

The receiver 60 is interconnected to the television set 70 over lines 62 so as to display graphics on the screen 72 of the television. The receiver 60 also receives transmitted signals 64 from a remote control 210. The remote control 210, under the preferred embodiment, is an infrared IR remote control (pulse-position modulation) although it is to be expressly understood that this input device could comprise buttons on the TV, on the receiver or on a separate electronics package; in which event, the link 64 would most likely be electrical wires. The receiver 60 is also interconnected over lines 66 to the elevation motor 100 and to the azimuth motor 110 both of which are mechanically interconnected to the TVRO dish 10 over mechanical links 102 and 112 respectively. The receiver 60 is also connected over lines 68 to an electronic compass 80 which is mechanically connected 82 to the dish antenna 10. The compass 80 is a magnetoflux compass and is hard mounted to the AZ-EL mount so that the compass accurately measures the magnetic direction of the mount. The compass 80 measures the approximate heading or direction of the mount (or RV). The antenna 10 is a 4.5 foot parabolic mesh antenna.

In general operation, the receiver 60 provides graphic communications in the form of screen menus to the monitor 72 of TV-70 over lines 62. The user of the present invention uses the remote 210 or other comparable input device to deliver signals over communication pathway 64 to the receiver in response to queries in the menus on TV 70. For example, a directory of cities could be displayed in the monitor of TV 70 and the user of the present invention could use the remote 210 to select a given city. Based upon that city's selection, the receiver 60 (in response to a reading from the electronic compass 80 delivered over lines 68) would issue motor control signals over lines 66 to the azimuth motor 110 and to the elevation motor 100 which would then mechanically position dish 10 in the general direction of the target satellite 90 in the Clarke belt 130.

The receiver 60 as shown in FIG. 2 uses a central bus 202 which conventionally comprises address, data, and control busses. The microprocessor 200 is interconnected to bus 202. In the present invention, microprocessor 200 is an 16 bit microprocessor such as that manufactured by Motorola Model 68008.

A clock 203 is used to provide clock signals to the microprocessor 200. In the preferred embodiment the conventional clock is a 5.365 MHz clock.

Also connected to the bus 202 is a Static Random Access Memory (SRAM) 204. A lithium battery 205 is used to provide power backup to the SRAM. The SRAM holds all channel information for each of the 36 channels and for up to 36 satellites (1296 channels total). The SRAM also holds all satellite position information (such as label, azimuth position, elevation position, and orbital position) . The channel and position information is loaded into the SRAM at manufacture. {he SRAM also holds the variable information as will be explained later. In the preferred embodiment, the conventional SRAM is a 32K by 16 bit memory.

Also connected to bus 202 is an Electronic Programmable Read Only Memory (EPROM) 206 which contains the software necessary to operate the system of the present invention. The EPROM is preferably 128K bytes in size. A real time clock 207 is conventionally interconnected to bus 202, a conventional video display processor (VDP) 208 is interconnected and a conventional video Dynamic Random Access Memory (DRAM) 209 is also interconnected. The output of the DRAM 209 is delivered over lines 62 and is conventional on screen display (OSD) video output. The VDP 208 works in conjunction with the microprocessor 200 to generate full screen menus that the user sees when operating the receiver. The microprocessor 200 writes information into the DRAM 209 and the VDP 208 processes the contents of this memory and converts it to video. It is with these menus, as illustrated later, working in conjunction with the IR remote 210 that the user operates the receiver 60. Preferably there are no front panel controls or displays on the receiver itself.

Also connected to bus 202 is the infrared decode circuit 211 which is conventionally interconnected to an IR sensor 212. Both components are conventionally available. A latch 213 is connected to the bus 202; in the preferred embodiment this is an 8 bit latch. A conventional eight bit analog/digital circuit (ADC) 214 is interconnected over lines 68 with the electronic compass 80.

The operation of the hardware configuration set forth in FIG. 2 will be more fully explained in the following. Generally speaking, the microprocessor 200 based upon programming appearing in EPROM 206 activates the VDP 208 to display in the TV 70 predetermined screen menus. The IR decode circuit 211 receives operator commands from the remote device 210 so as to cause the microprocessor 200 to follow the correct operating sequence desired by the user. The microprocessor 200, by loading proper data in latch 213, can precisely cause the azimuth motor 110 to increment in the azimuth direction and can cause the elevation motor 100 to increment in the elevation direction. The microprocessor 200 can obtain the precise heading of the dish 10 by reading the ADC circuit 214 which carries the compass reading.

In FIG. 2, the details of the conventional receiver operation are not set forth. One aspect of the present invention is the ability to tune into an audio subcarrier during a rough and fine tune search as will be discussed later. The circuitry for receiving and tuning is conventional, however, the conventional audio sub-carrier demodulator 261 has been modified to deliver the analog signal of the subcarrier over line 262 into the ADC 214 so that the corresponding digital value of the signal can be used by the microprocessor 200 in the search process.

The receiver 60 circuitry set forth in FIG. 2 is a preferred embodiment. It is to be expressly understood that variations to this circuitry could be made by one skilled in the art under the teachings of the present invention.

System Operation

Figure 3:
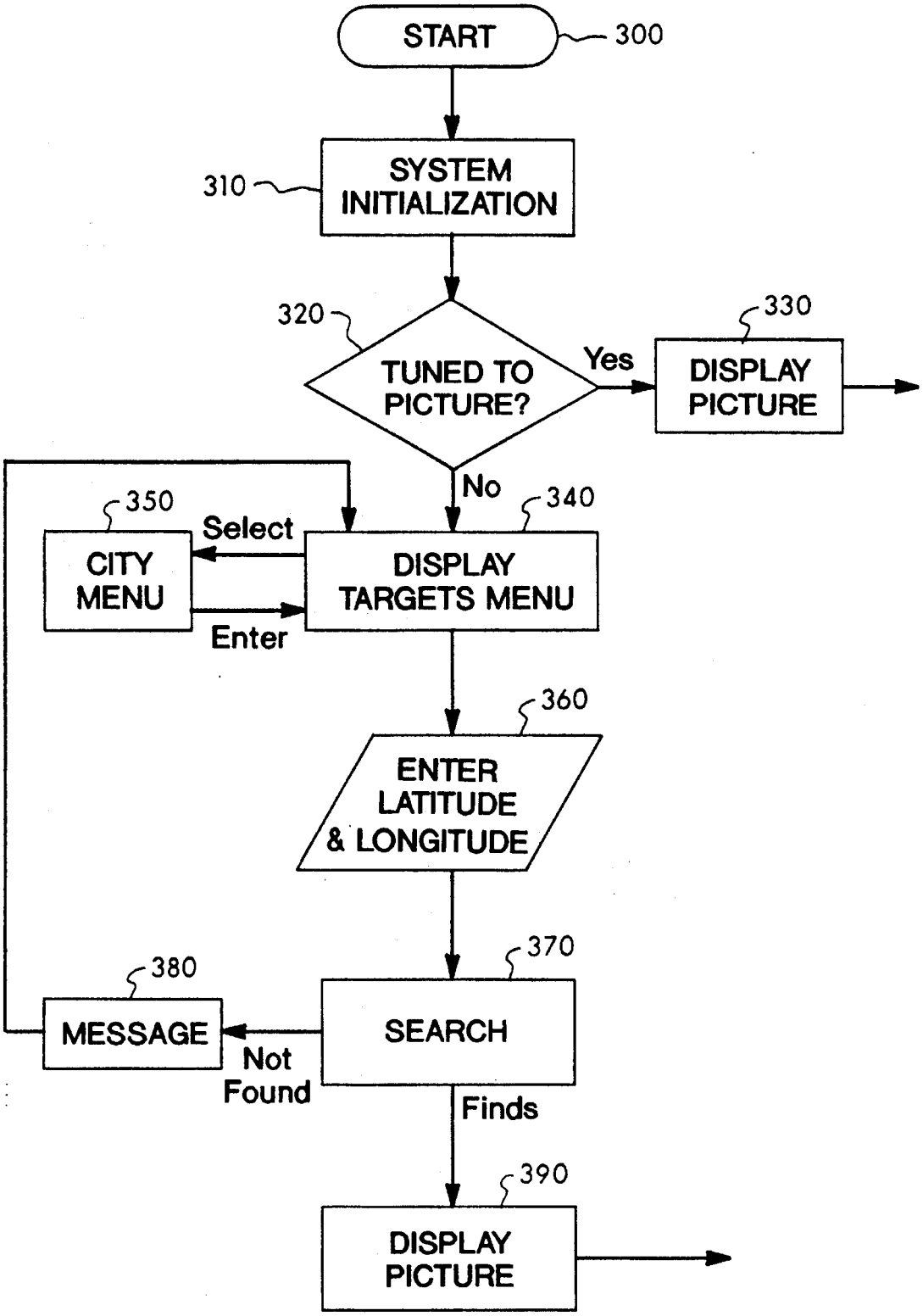
FIG. 3 sets forth the system activation flow chart of the present invention.

In FIG. 3, the overall system operation is shown. The operator turns on the system at stage 300. That is, the user turns on the receiver 60 and the television 70. The system becomes initialized in stage 310.

In stage 310, the satellite dish antenna unfolds from the traveling position and orients to an initial position. This initial position would be, for example, the last position the antenna 10 was oriented by the user in order to receive a picture from a satellite dish antenna (i.e., the night before at a different campsite). If the RV 30 had not moved to a new location and was still in the same position, the antenna 10 would simply position to the last viewed satellite. In stage 320, therefore, if the dish is already tuned to a satellite and a picture is received, stage 330 is entered and the tuning process is complete. The user will conventionally view the TV and move from satellite to satellite and from transponder to transponder in a conventional fashion.

However, if the dish antenna is not tuned to a transponder, stage 340 is entered and the target menu is displayed. In FIG. 4, an example of a target menu is shown.

In FIG. 4, the target menu 400 is displayed on TV 70. As shown in FIG. 4, a city field 410, a latitude field 420, longitude field 430, a compass heading 450 and several search characteristics fields 460 are provided. The user can select items 1 through 9 and when an item is selected, information may be selectively entered. For example, if the RV was in Burlington, Iowa the night before and now is in or near Sioux City, Iowa, the city item field 410 would be selected so as to modify this field 410. The user selects item "1".

In FIG. 5, the city menu 500 is now displayed. Hence the user will select Sioux City 510 which will then be loaded by the microprocessor 200 into the target menu with Sioux City's coordinates of longitude and latitude. This provides approximate latitude and longitude values to the receiver. This occurs in stage 350 as shown in FIG. 3.

Returning to FIG. 4, the system has already read the compass reading from compass 80 and has entered in the compass heading or direction in field 450. Hence, the operator would select item 9 "Search for Satellite" and stage 370 is entered.

It is to be understood that in stage 340, the operator could have referred to a map or other information to obtain a more precise longitude and latitude (such as a U.S. Geophysical map for the campground area). In which case the user would have selected items 2 and 3 in FIG. 4 to manually enter the longitude and latitude in stage 340. It is also to be expressly understood that the operator could override the compass by entering step 4. In which case, the operator could turn the compass off and manually read a compass so as to enter the heading in step 5. However, in normal operation, all that is required is for the user to select the nearest city which in the above example is Sioux City. The city information is stored in SRAM 204. The city list is a list of geographical locations that the system might be moved to and each entry in this list contains a name, state code, corresponding location (latitude/longitude) and the magnetic declination associated with the location. In addition, the target menu 340 allows the operator to change the search characteristics: the initial predetermined satellite, the search channel and the search frequency. This will be discussed subsequently.

Returning to FIG. 3, with the longitude and latitude for Sioux City entered in stage 360, the system automatically moves the satellite 10 searching for the predetermined satellite, for example, ANIK-E2. This searching process involves rough and fine tune searches in stage 370. If the predetermined satellite is not found, stage 380 is entered and a message is generated on the screen that the target satellite could not be found upon which stage 340 is entered and the process repeats. However, in the event the target satellite (ANIK-E2) is found, stage 390 is entered and the picture is displayed.

The operation of the system set forth in FIG. 3 requires only minimal operator input. In the typical case, simply selecting the nearest city from the city menu 500 in stage 350 is all that is required. From that point on, the system is fully automatic in aligning the satellite dish 10 to the target satellite 90. When aligned with the target satellite 90, the other satellites in the Clarke belt can be automatically calculated.

The menus shown in FIGS. 4 and 5 are those of the preferred embodiment. It is to be expressly understood that variations could be made thereto. For example, a digitized map could be shown as a menu and the location could be suitably chosen using a mouse control or the like.

In summary, the automated method of the present invention (1) generates a magnetic direction signal from a magnetic compass mounted on the satellite dish antenna, (2) stores a plurality of latitude and longitude coordinates correlated to a plurality of geographical locations, (3) displays in the TV the geographical locations so that the user can select one, and (4) determines an initial search position based upon the magnetic direction signal and the selected latitude and longitude coordinate.

Audio Subcarrier Search

An important feature of the present invention is the ability of the system to search for a specific audio sub-carrier located in the target satellite. In FIG. 6 are a list of potential target satellites that could constitute the target satellite of the initial search. For each potential target satellite, a particular or predetermined channel has been selected and for that channel a unique sub-carrier audio frequency is chosen. In scanning the list of FIG. 6, it is noted that each audio sub-carrier frequency is uniquely different from the adjacent satellite's selected sub-carrier frequency. For example, ANIK-E2, channel 6 has a selected audio frequency of 5410 KHz which is different from the adjacent GALAXY satellite channel 13, sub-carrier frequency of 5760 KHz. Under the teachings of the present invention and in the preferred embodiment, 10 channel 6 of ANIK-E2 having a sub-carrier frequency of 5410 KHz represents a unique searching audio frequency of strong signal strength. The goal is to not use frequencies which are common to the same channels of adjacent satellites such as 6800 KHz.

As shown in FIG. 6, menu 600 is displayed on TV 70 and the user at any time can select another satellite as the target satellite for the initial search by simply selecting a field such as 610.

Under the teachings of the present invention, the selected audio subcarrier is unique. That is, the frequency of the selected audio subcarrier is not present in the corresponding channel of any satellites near the target satellite.

In the preferred embodiment, the search menu of FIG. 6 is the list that contains the information necessary for the system to perform the search for the target satellite by looking for a predetermined subcarrier audio frequency at a predetermined channel or transponder location. This search characteristic list is stored in the SRAM 204. Use of the system of the present invention is as simple as entering the approximate latitude and longitude. Once these have been established, the search routine of FIG. 3 finds the target satellite. Upon locating the target satellite, the system accurately locates the position of all of the remaining satellites in the Clarke belt. In typical operating time, the operation of FIG. 3 is accomplished in as few as two or three minutes. The present invention greatly simplifies the process of locating each satellite and minimizes the knowledge requirements of the user who, under prior approaches, had to watch the television for a passing image.

Under the teachings of the present invention, by selecting a unique subcarrier audio frequency, the target satellite can be located accurately. For example, all satellites have a 6.8 megahertz audio subcarrier frequency. The selection of this audio frequency would be inappropriate since upon detection, the actual identity of the satellite would not be known. However, selecting 5.41 megaHertz in channel 6 of satellite ANIK-E2 would be appropriate, since no other satellite adjacent to the ANIK-E2 has a 5.41 megahertz audio subcarrier frequency. Hence, this is an important part of the present invention in that the targeted audio subcarrier frequency is uniquely different from the audio subcarrier frequencies of the adjacent satellites. This is also to be contrasted with the most conventional prior art approaches that look for video frequencies. All video center frequencies look alike from satellite to satellite and, therefore, it is impossible to determine which satellite has been detected and to which satellite the system is tuned. Hence, these prior art systems require that the operator visually identify the satellite by watching the received signal. This requirement is obviated under the teachings of the present invention.

Searching for the Target Satellite

Figure 7:
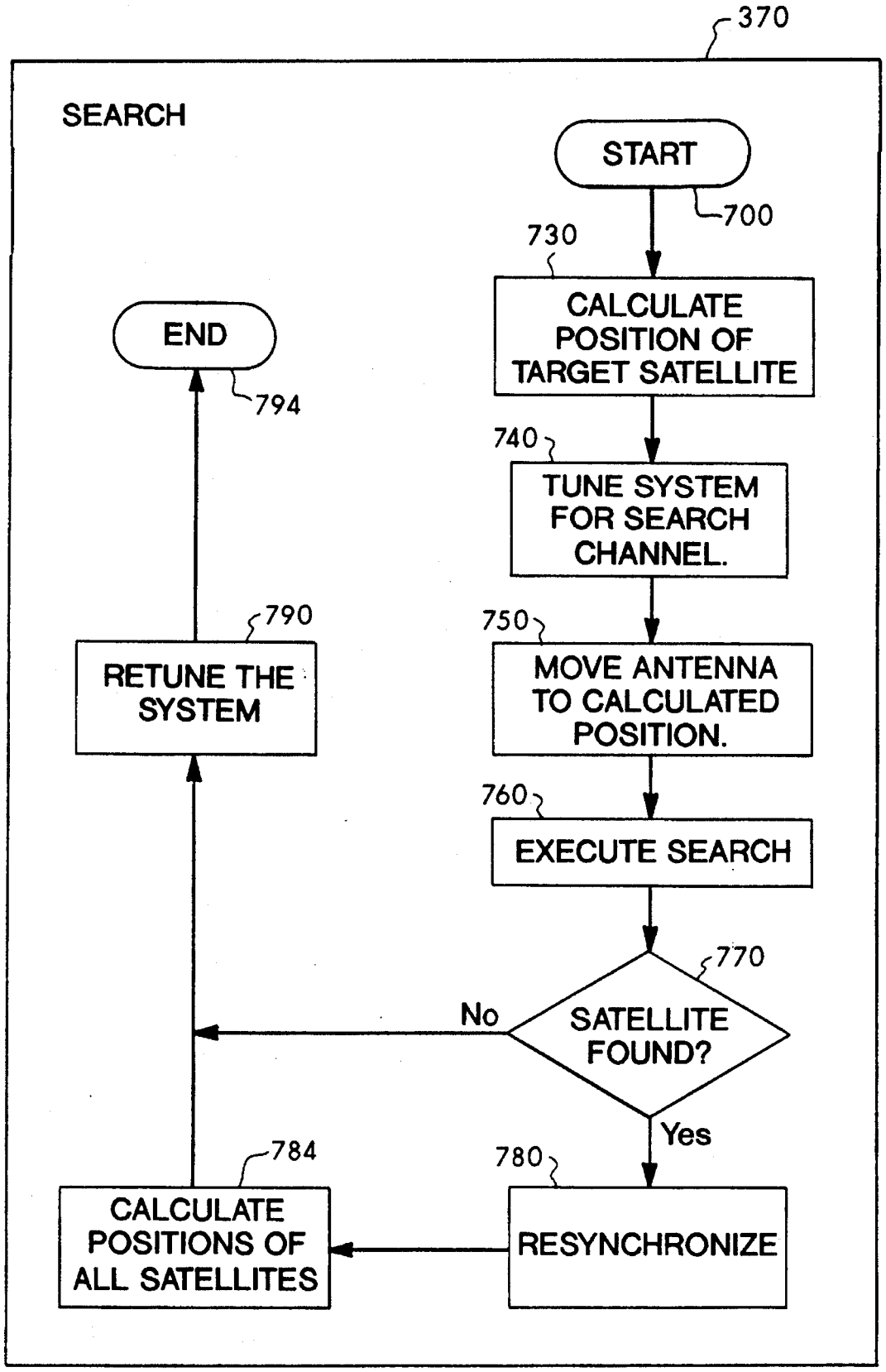
FIG. 7 sets forth the search flow chart for the overall operation of the system.
Figure 8:
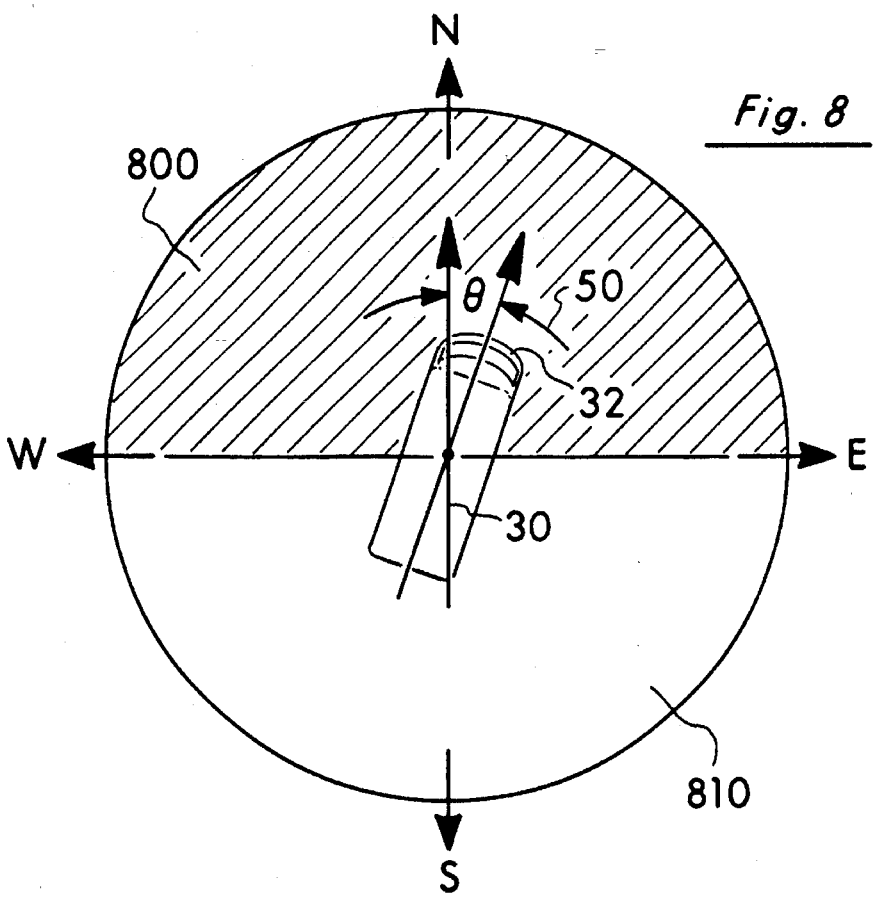
FIG. 8 is an illustration showing the orientation of a recreational vehicle oriented in the northerly direction.

In FIG. 7, the method of searching for the target satellite implemented by the receiver 60 in cooperation with the dish antenna 10 is shown. FIG. 7 sets forth the detailed steps for the search stage 370 of FIG. 3. Stage 370 is entered at 700. As shown in FIG. 8, the RV 30 may be oriented with the front 32 of the RV pointed in the northern hemisphere 800. If the front 32 of the RV 30 is pointed in the southern hemisphere 810, then the reading from the electronic compass 80 delivered over line 68 into the receiver 60 causes the microprocessor 200 to adjust the following calculations by 180°. If the RV is pointed in the northern hemisphere 800, then stage 730 is entered. If the RV is pointed in the southern hemisphere, then stage 730 is entered with the calculation adjusted by 180°.

In stage 730, the microprocessor 200 calculates the initial search position of the target satellite 90.

Calculation of Target Satellite Initial Search Position

Figure 10:
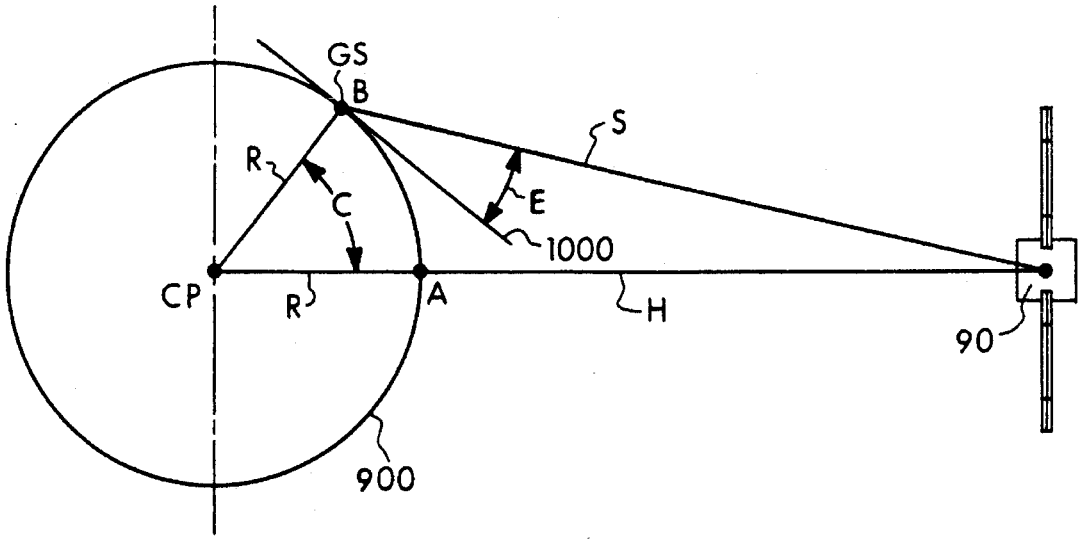
FIG. 10 is a side view representation of FIG. 9.
Figure 9:
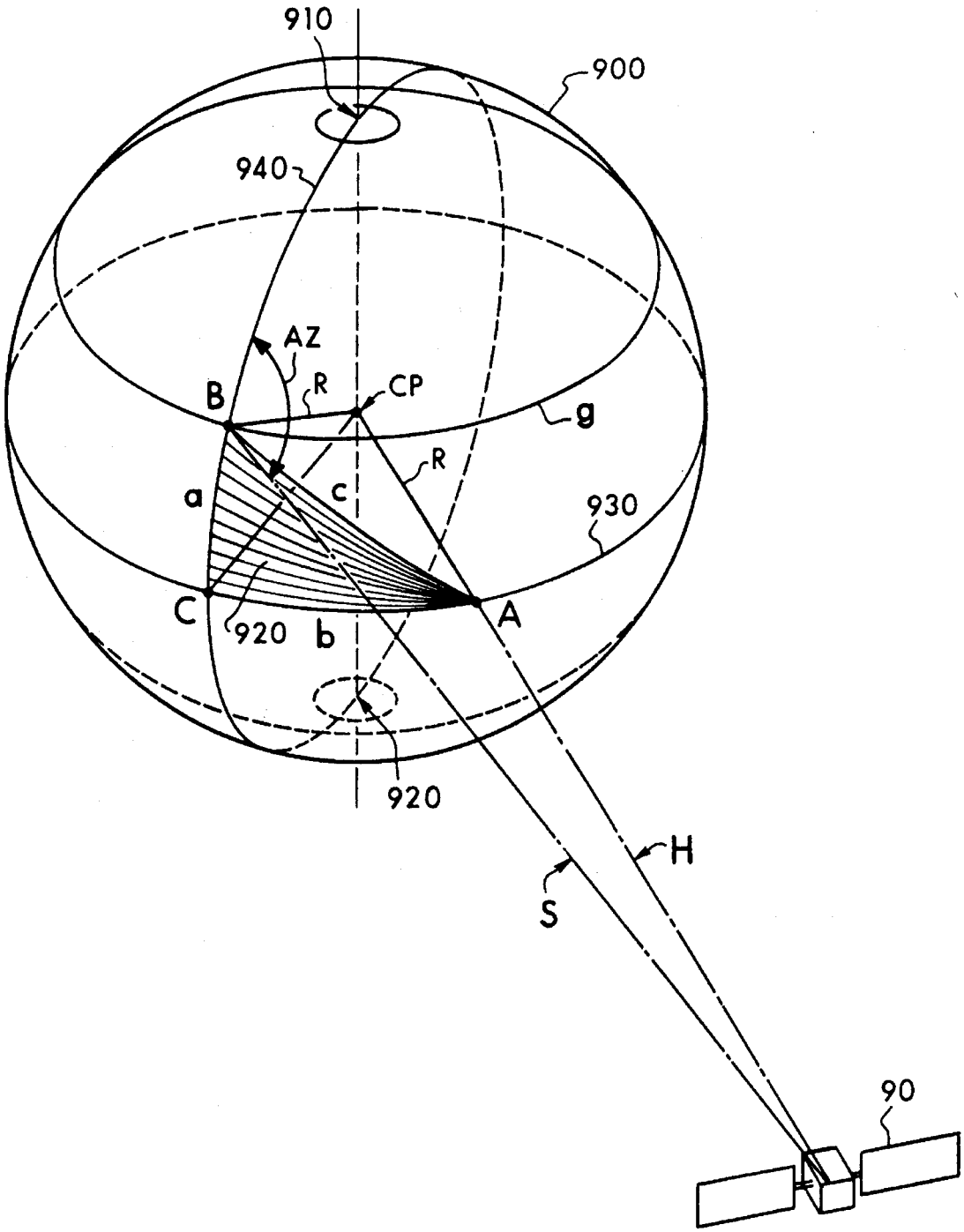
FIG. 9 sets forth a geometric relationship of a satellite with respect to the location of the recreational vehicle on the surface of the earth.

The satellite dish antenna 10 is first moved to an approximate position of the target satellite based upon the latitude, longitude and magnetic declination corresponding to the city nearest to where the campsite is located (or, as manually entered by the operator). This approximate position is calculated as follows:

In FIGS. 9 and 10, the conventional TVRO-satellite geometry is set forth. In FIG. 9, the earth 900 is stylized having the North Pole located at 910 and the South Pole located at 920. The target satellite 90 is located in the Clarke belt which is directly above the equator. The center point of the earth is at CP. Shaded area 920 represents a portion of the surface of earth 900. Line segment AC, having a length "b" is along the equator 930. Line segment BC, having a length "a", is along a circular arc 940 which travels through point B, which is the location of the satellite dish antenna 10, to a corresponding latitude point C on the Equator 930. Line segment AB having a length "c" is the distance between the satellite dish antenna at point B and the satellite subpoint A on the Equator 930. Target satellite 90 has an altitude H above the surface 900 which is the distance from A to target satellite 90. Of course, point A is located R from the center CP of the earth. Hence, the distance S from the target satellite 90 to the TVRO satellite dish 10 at point B is the slant range. The azimuth angle Az is the angle between line S and the center line 940.

In FIG. 10, a different view of the geometry of FIG. 9 is presented. Here, the elevation angle E is shown as the angle between the tangent line 1000 with the earth 900 at point B and the slant range S.

Based upon the TVRO satellite geometry set forth in FIGS. 9 and 10, which is conventional, the microprocessor 200 of the present invention is able in stage 730 to calculate the approximate position of the target satellite 90.

In the calculations set forth later, the following values are utilized:

B=the location of the recreational vehicle or ground station (GS)

a=latitude of point B (positive in a northern hemisphere)

c=great circle arc from point B to point A g=longitude of point B (east is positive)

f=longitude of target satellite 90 (east is positive)

b=g−f

Az=azimuth angle

E=elevation angle

S=slant range

H=altitude of satellite

R=radius of earth

It is to be understood that the values of f, H, and R are all fixed for the target satellite and are stored in the EPROM 206 of the receiver 60.

Calculation of Approximate Elevation Angle

The calculation of the approximate elevation angle E is:

Formula 1:

$$E = \mathrm{Cos}^{-1}\left[\frac{S^2 + R^2 - (R+H)^2}{2RS}\right] - 90$$

where:

$$s=[R^2+(R+H)^2-2R(R+H)]\mathrm{Cosc} \qquad \text{Formula 2}$$

$$\mathrm{Cosc}=\mathrm{Cosa}\mathrm{Cosb} \qquad \text{Formula 3}$$

These calculations provide the true elevation angle E. This must be transformed onto the motor driven mount for moving the antenna 10 in the elevation direction. The following calculations are based upon the antenna mount set forth in the above identified related invention. It is to be expressly understood that the teachings of the present invention are not limited to the precise mounting design of the related invention and that any suitable mechanical mount could be similarly transformed so as to be used under the teachings of the present invention. Hence, the following discussion of FIGS. 11*a* through 11*c* is for the preferred embodiment and is not meant to limit the teachings of the present invention in any fashion. The mount of the related invention has three pivot points, P1, P2, and P3. FIG. 11*a* shows the antenna 10 in the stowed position, FIG. 11*b* shows the antenna 10 unfolding and FIG. 11*c* shows the antenna 10 tuned to the target satellite.

In FIG. 11*a*, pivot point P3 is fixed to the roof of the RV. It is connected to pivot point P2 by means of a member having a length of R1. Pivot point P1 moves along line 1100 on the roof a plus or minus distance. Line 1100 represents the direction of actual travel, hence, point P1 can move in plus or minus incremental steps along line 1100. Pivot point P1 is connected to pivot point P2 through a member 1120 having a length of R2. Point P3 is separated from line 1100 by a distance d. Member 1120 extends beyond point P2 and at 1130 undergoes an angle B with respect to member 1120 and forms a new member 1140 which connects to antenna 10. Line 1150 is the antenna bore-sight of antenna 10. Line 1160 is the horizon line. As shown in FIG. 11*a*, elevation angle E is the angular relationship between the antenna bore sight 1150 and horizon 1160.

In the preferred embodiment, the following are the values for the mount of the related invention:

E=−90°≦E≦90°

R1=5.526"

R2=5.066"

d=3.00"

B=−9.227°

−1.000"≦x≦11.000"

As mentioned, FIG. 11*a* represents the antenna in the stowed position with the bore-sight 1150 pointed at the roof.

In FIG. 11*b*, the receiver 60 activates the elevation motor 100 to move point P1 in direction of arrow 1170. This causes point P2 to move upwardly in the direction of arrow 1172. At this point, point P1 is incrementally moving in the plus direction. The bore-sight 1150 of the antenna 10 is still below the horizon 1160. An important feature of the present invention pertains to the initial raising of the antenna in the E direction. The software in the receiver requires that the antenna is lifted upwardly a certain or predetermined height, Z, as shown in FIG. 11*b*, before any rotation in the Az direction takes place. This is necessary to prevent the antenna from hitting nearby objects (such as air conditioning, vent pipes, etc. ) on the roof of the vehicle.

In FIG. 11*c*, the antenna 10 is pointed in the proper elevation direction of the target satellite 90.

Based upon the elevation transform model of FIG. 11, the value of x of can be calculated as follows:

$$x=R2\ \mathrm{Sin}\ (E+B)+[R1^2-(d-R2\ \mathrm{Cos}\ (E+B))^2]^{1/2} \qquad \text{Formula 4}$$

The value of x is the distance of movement required by actuator motor 100 to achieve the desired elevation angle E. This value would be the actual value required assuming the actuator actually coincided with line 1100.

Figure 12:
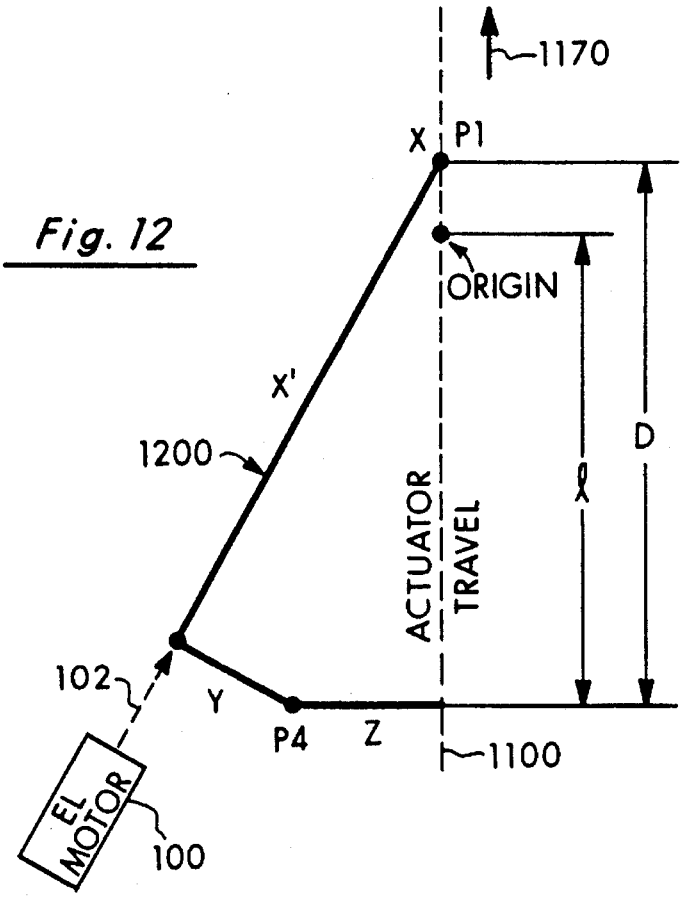
FIG. 12 sets forth the geometric relationships between the elevation motor and the mount of the present invention.

However, in the preferred embodiment, the actuator is offset from line 1100 as shown in FIG. 12. In FIG. 12, the actuator travel line 1100 of FIG. 11 is shown. Point P1 slides along that line in the direction of arrow 1170. In FIG. 12 the following dimensions are based upon the mount of the related invention:

z=distance from line 1100 to pivot point P4=4.500"

y=distance from pivot point P4 to the center line of the actuator 1200=1.125"

D=the stowed dimension=27.785"

x'=the distance that the actuator moves l=the length from line z to the ORIGIN=26.785"

$x_{min}$=the minimum x distance=−1.000"

D=l−x $C_{el}=(x_{max}'-x')pt$=number of counts for elevation.

t=lead screw pitch for the actuator in Turns Per Inch (TPI)

p=pulse edges per revolution $x_{max}'$=Maximum length of actuator=28.125"

The values of t and p for a particular actuator 1200 are constant. The pulse edges per revolution p are based upon an optical interrupt approach detecting the edges per revolution. The geometric relationship in FIG. 12 simply provides the offset relation of x to x'. Hence, x' is related to x:

$$x'=[(D+x_{min}-x)^2+z^2-y^2]^{1/2} \qquad \text{Formula 5}$$

Hence, the actual number of counts necessary to achieve a certain amount of elevation angle E for a particular actuator has been calculated. The computer upon performing the above calculations commands the elevation motor 100 through latch 213 to activate the actuator by a certain number of counts $C_{el}$ over the mechanical interconnection 102, as shown in FIG. 12. The antenna is moved to the elevation initial search position.

Determining Azimuth Increments

Returning to FIGS. 9 and 10, the azimuth calculations are determined as follows:

Formula 6:

$$Az=\mathrm{Tan}^{-1}\left[\frac{\mathrm{Tan}b}{\mathrm{Sin}a}\right]+180$$

Figure 13:
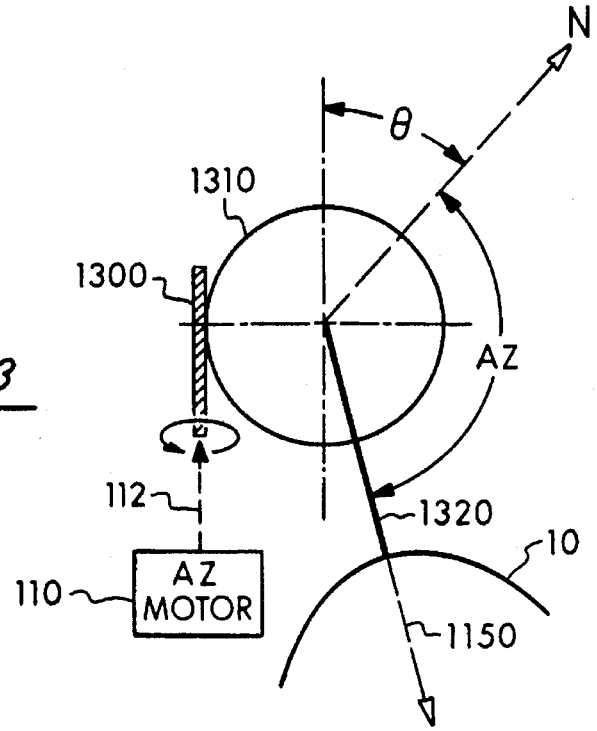
FIG. 13 sets forth the geometric relationship between the azimuth motor and the mount of the present invention.

In the preferred embodiment of FIG. 13, the worm gear 1300 engages a ring gear 1310. The dish 10 is mounted on the ring gear by member 1320. Hence, the azimuth Az can be adjusted based upon the following formula:

Formula 7:

$$C_{AZ}=\frac{NP(Az-\Theta)}{360°}$$

The following values are used in the above formula:

N=number of teeth on the ring gear 1310

P=pulse edges per revolution of the worm gear 1300

θ=compass setting=−90°≦θ≦90°, −90° is east, +90° is west $C_{az}$=the counts necessary for the Az motor 110 through the mechanical linkage 112 to rotate the worm gear to achieve the desired azimuth of the target satellite Again, the precise embodiment shown in FIG. 13 corresponds to the mount set forth in the related invention. It is to be expressly understood that any other mechanical apparatus adjusting the antenna 10 in the azimuth direction could be likewise mathematically transformed under the teachings of the present invention and the present invention is not limited to the precise disclosure of FIG. 13.

Returning back to FIG. 7, at this point stage 730 is completed. The antenna at this point in time is approximately positioned, under control of receiver 60, to the target satellite.

Stage 740 is then entered. In stage 740, the receiver 60 is tuned for a selected audio frequency of the target satellite which in the target menu of FIG. 4 is ANIK-E2, channel 6, audio subcarrier frequency 5.41 megahertz.

In stage 750 the antenna is now physically moved to the calculated Az initial search position of stage 730. Once in the initial search position, stage 760 is entered and the search now commences for the selected audio frequency in the selected channel of the target satellite.

Rough-Tune Search-Pattern

Figure 15:
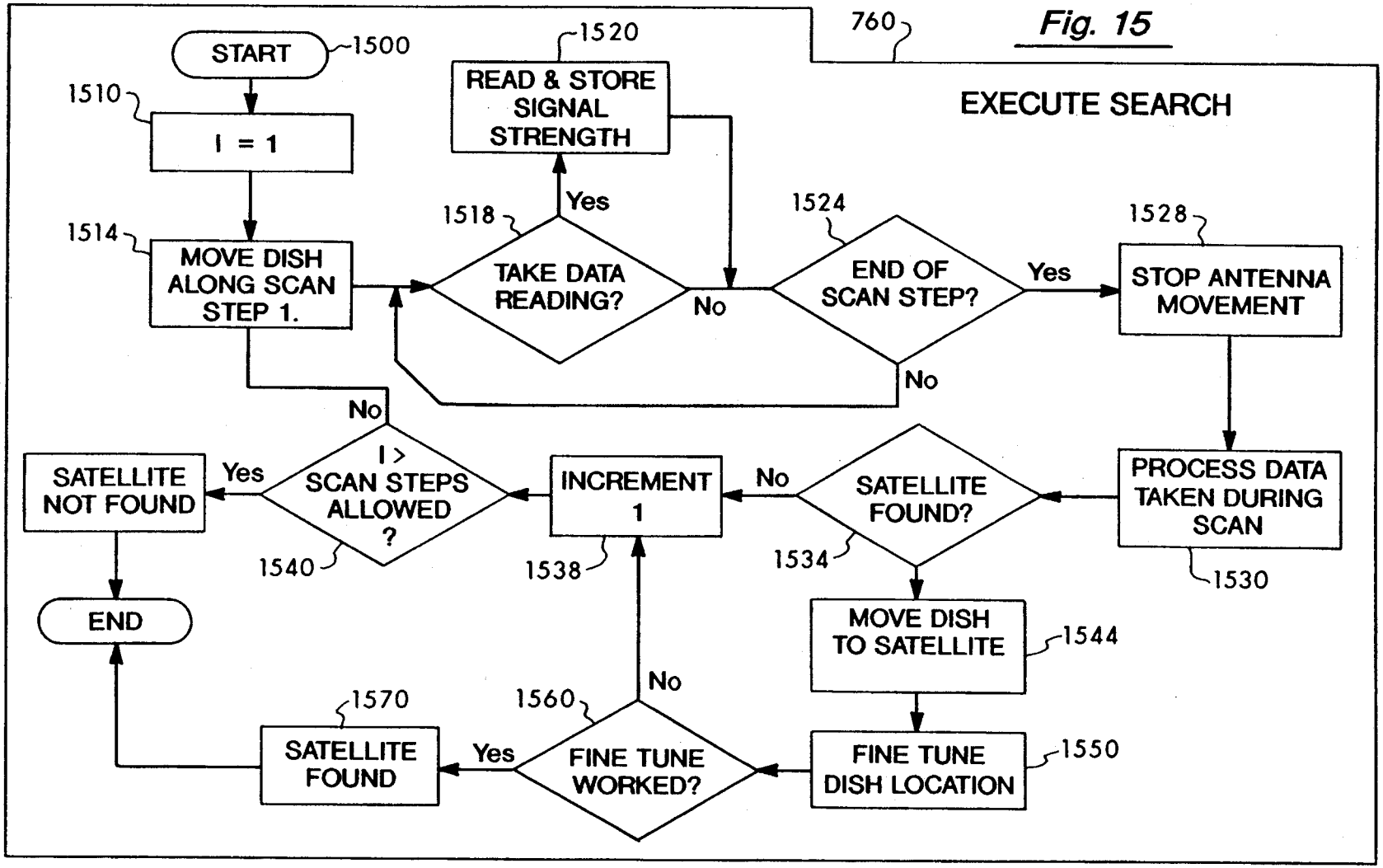
FIG. 15 sets forth the flow chart for the execute search.

FIG. 15 illustrates the steps taken by the present invention to conduct the rough-tune for the selected audio frequency of the selected channel. The executed search stage 760 is entered at the start 1500. At stage 1510, the initial scan step of I is set to 1. Stage 1514 is then entered. At this point, reference to FIG. 14 is important. In FIG. 14, the antenna 10 has its antenna bore-sight pointed at an initial calculated position which in FIG. 14 is referenced as J. The value of J was calculated in stage 730 and is the position of the Az and E motors.

The rectangular spiral search pattern shown in FIG. 14 for the rough-tune incrementally moves to the right in the u direction then incrementally downwardly in the perpendicular v direction, then to the left in the 2u direction, then upwardly in the 2v direction, etc. This provides an ever expanding spiral search pattern. The rough-tune search pattern moves the antenna in a first linear direction, which could be either the Az or E direction, a given amount, u. The antenna is then moved in a second linear direction which is perpendicular to the first linear direction a second given amount, v. In the preferred embodiment, the antenna is then moved in the opposite direction an amount equal to twice the first given amount or 2u. It is to be understood that "u" could be increased by any suitable constant value which in FIG. 14 is by the amount of "u". The antenna is then moved in the opposite direction of the second linear direction an amount equally twice the second given amount or 2v. It is to be understood that "v" could be increased by any suitable constant value which in FIG. 14 is by the amount of "v".

Returning now to stage 1514 of FIG. 15, the bore-sight of the dish is initially moved from point J along the u direction for a first scan step of I=1. During this movement, a predetermined number of readings such as 12 are taken. During the u movement, in stage 1518, these 12 discrete readings are taken by the receiver 60. It is important to remember that receiver 60 is tuned in to receive a precise subcarrier audio frequency. The 12 readings are taken at evenly spaced intervals during the "u" movement. In stage 1520 the readings are stored as to the signal strength detected. The processor stores this information in the SRAM 204. Stage 1524 is then entered to ascertain whether or not the 12 readings have been taken. If 12 readings lave been taken, then stage 1528 is entered. The antenna is then stopped at point 1400. Stage 1530 is entered. In stage 1530 the 12 readings taken during stage 1518 are processed.

Figure 16:
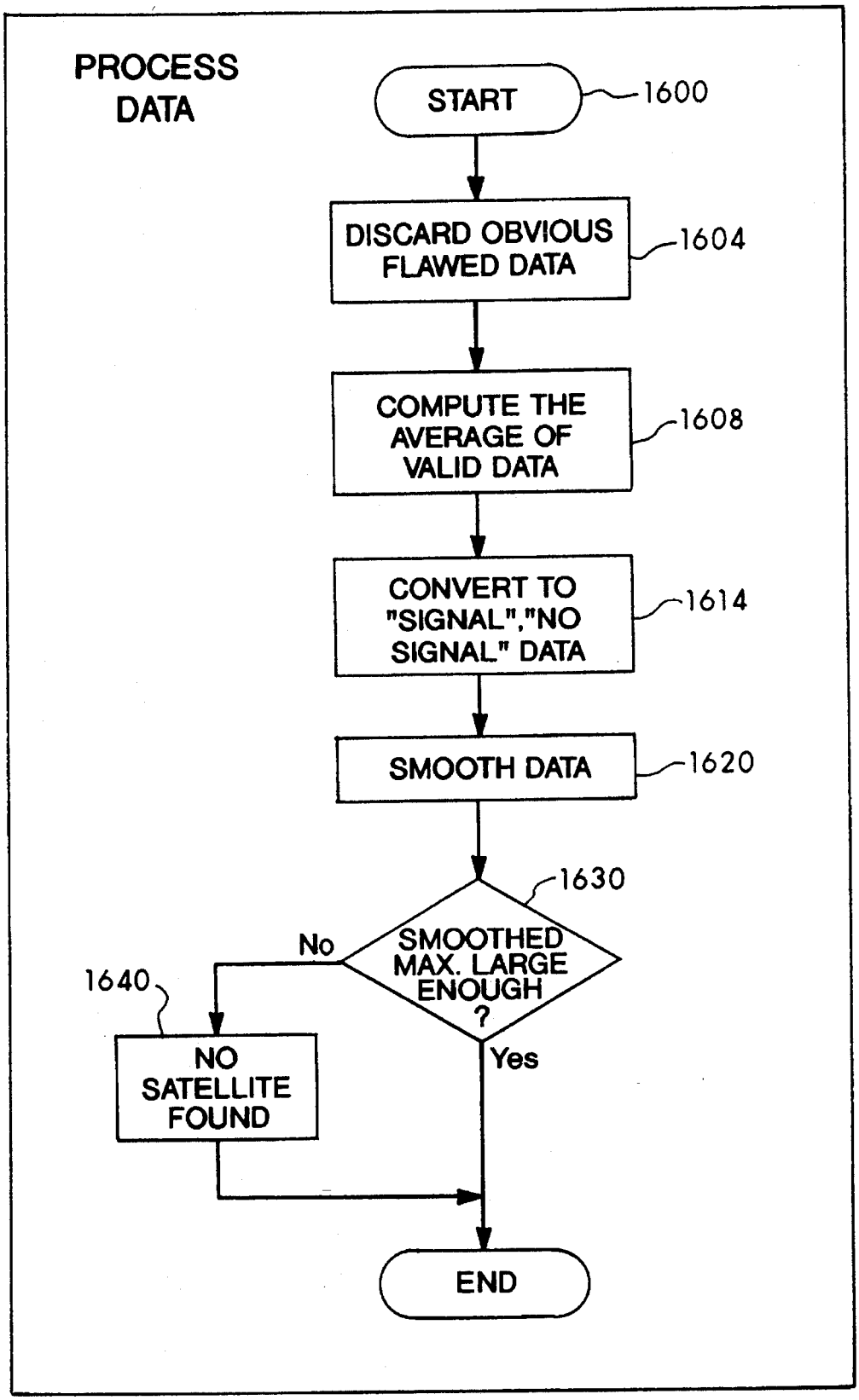
FIG. 16 sets forth a flow chart for processing data.

FIG. 16 sets forth the details of the process data step 1530. This stage is entered in the start 1600 and the first stage 1604 utilizes a statistical program to discard obvious flawed data. In the preferred embodiment, the ADC 214 of FIG. 2 may not operate fast enough thereby generating "zero" readings. This data, when sampled, was obviously flawed and is discarded.

Figure 20A:
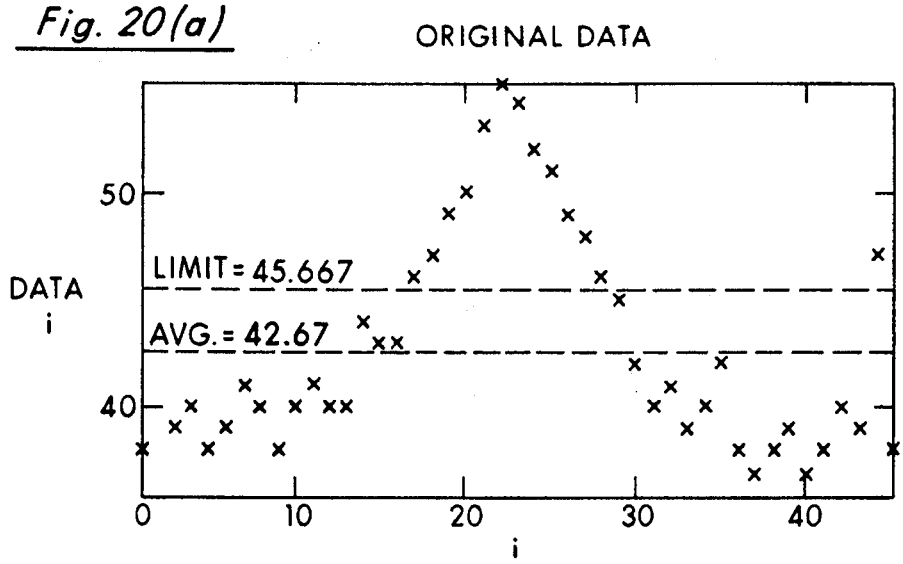
FIG. 20 illustrates the detection of a valid peak "signal".
Figure 20B:
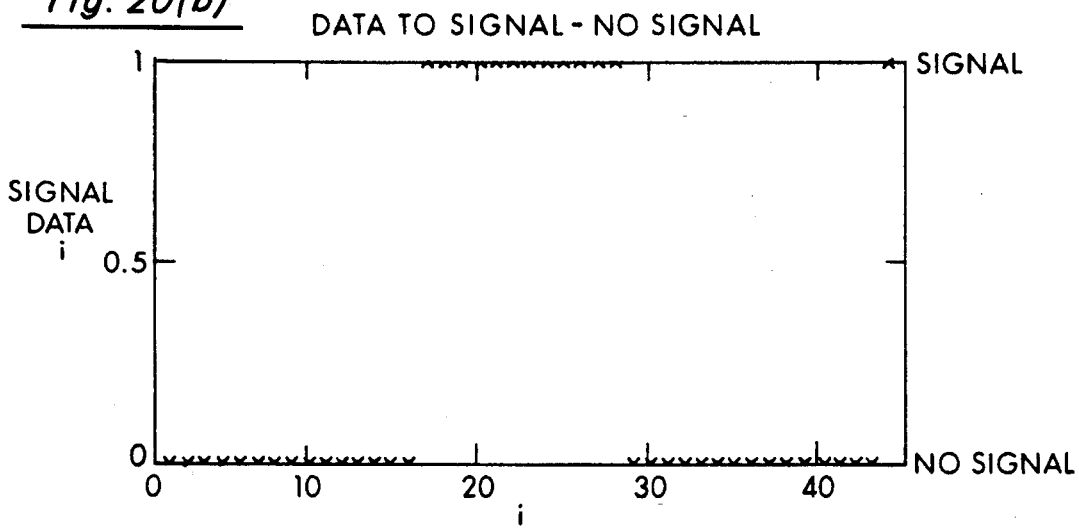
Figure 20C:
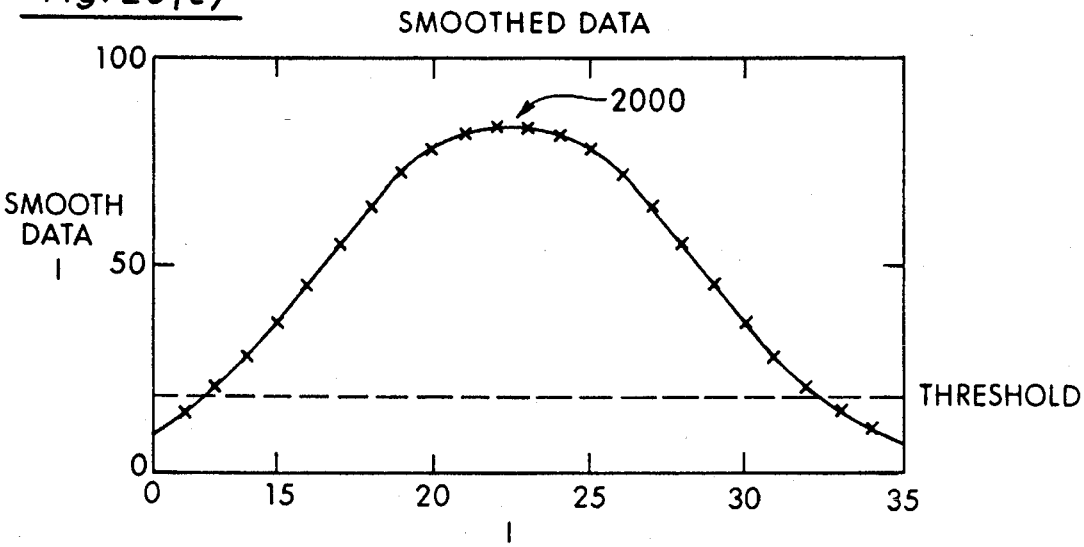

Stage 1608 is then entered which computes the average of the remaining valid data. FIG. 20 sets forth an example of data illustrating a satellite which will be found, whereas FIG. 21 sets forth an example of data illustrating a situation in which data will not be found. In FIGS. 20(*a*) and 21(*a*), the original data without the flawed data is shown. The horizontal axis sets forth the reading, i, and the vertical axis sets forth the signal strength. In stage 1608, the average is calculated, which for FIG. 20 (*a*) is 42.667, and for FIG. 21 (*a*) is 40.6. In stage 1614, the signal is converted to a "signal" or "no signal" value. This is represented in FIGS. 20(*b*) and 21(*b*). Whether the signal data is recorded as a "signal" or "no signal" (i.e., either a 0 or a 1), is based upon whether or not the individual signal data is above the determined average. In the preferred embodiment, a level of "3.0" is utilized so that the limit is 3.0 above the average. In the case of FIG. 20, the average is 42.667. Adding 3 to this results in a limit of 45.667. Hence, all data points above 45.667 become a "1" or a signal and all values below the limit become a "0" or no signal as shown in FIG. 20(*b*). The same is true of FIG. 21(*b*).

Stage 1620 is then entered and the data is smoothed. This is shown in FIGS. 20(*c*) and 21(*c*). The data that is smooth is a collection of 1's and 0's as previously discussed. The weight of each data point upon its neighbors is determined by its distance from its neighbors. Points that are further away than the range are considered to have no effect.

Figure 21A:
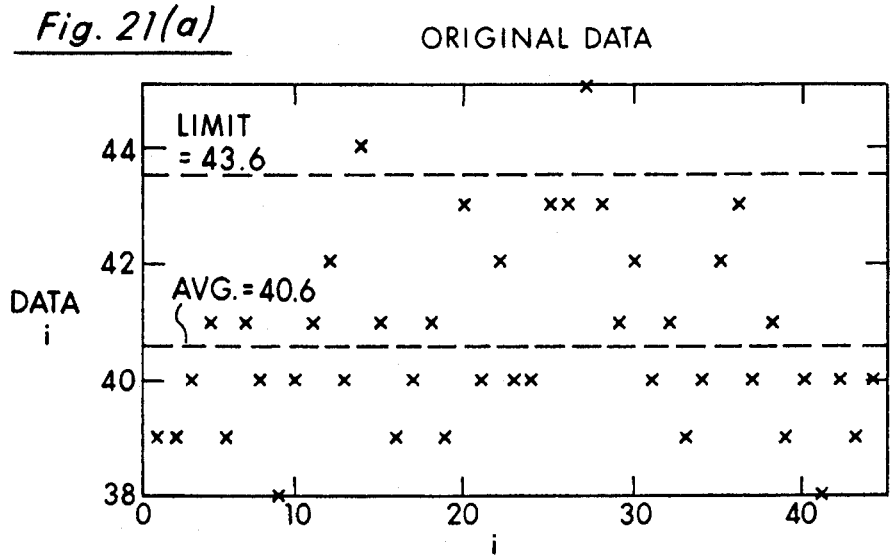
FIG. 21 illustrates the detection of "no signal".
Figure 21B:
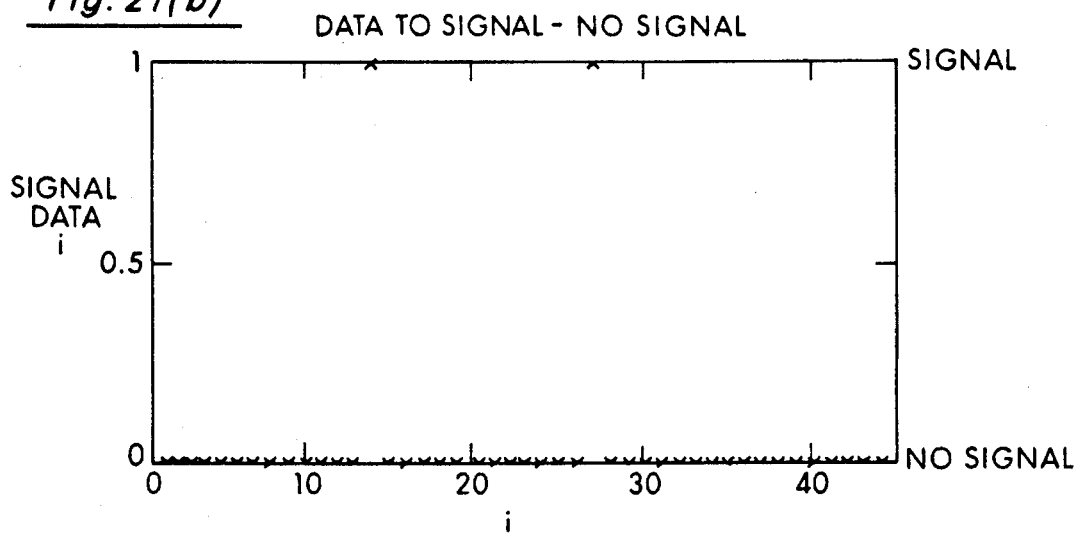
Figure 21C:
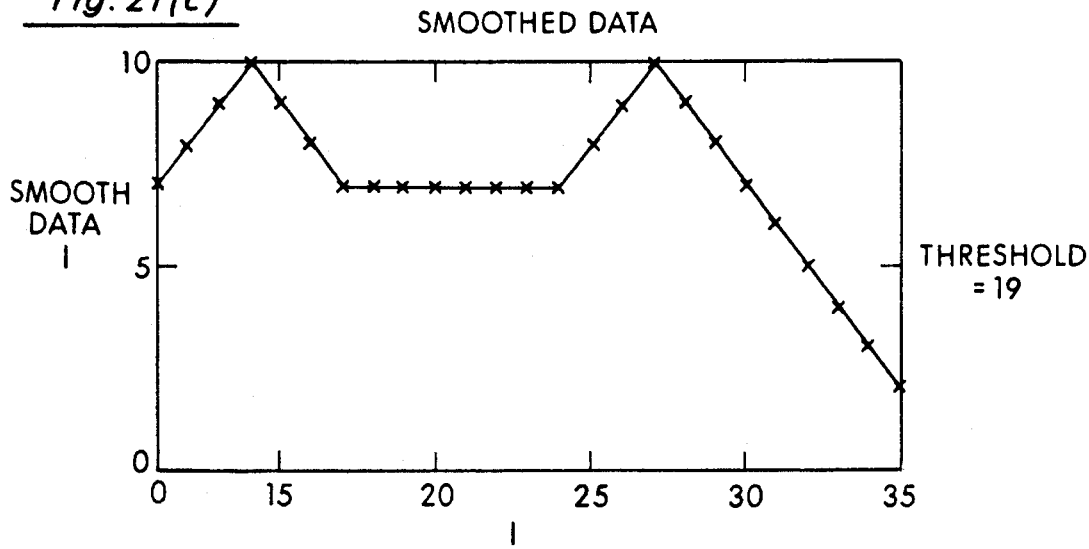

Hence, In FIG. 20(*c*) and 21(*c*), the smooth data appears for each example. In FIG. 20(*c*), the peak is found at 2000. The threshold of 19 is also shown in FIG. 20 (*c*). The peak 2000 represents the position of a found satellite. In FIG. 21(*c*), the threshold is also 19 and two peaks are found indicating that the satellite cannot be located.

Stage 1630 is then entered. A determination is made as to whether or not the smoothed maximum peak is large enough. If not, stage 1640 is entered and the process data stage 1590 is ended. On the other hand, if the smooth maximum is large enough, then the process stage is ended successfully.

With reference back to FIG. 15, stage 1534 is then entered to ascertain whether or not the target satellite has been found. If the target satellite has not been found, then stage 1538 is entered which causes the increment for the scan step to increment by 1. In stage 1540 a question is asked as to whether or not the permitted number of scan steps for I has been exceeded. If not, stage 1514 is reentered and during this scan the spiral search pattern now moves a distance v towards point 1410. Again, twelve readings are taken and the antenna is stopped at point 1410 in stage 1528. Twelve is a convenient number and any number could be used since this is based upon the availability of memory in the SRAM 204. Again, the data is processed and if the satellite is not found in stage 1534, the search pattern continues from point 1410 to point 1420 for a distance of 2u.

Assume with respect to FIG. 14 that at point K corresponding to the tenth data reading in scan step I=3, a maximum peak is detected in stage 1630 by the process data stage 1530, thereby indicating that the target satellite is found. In stage 1534 the system moves from stage 1534 to stage 1544 which causes the satellite dish antenna to move its bore-sight to correspond to point K. Stage 1550 is then entered. This is the fine tune stage of the present invention.

As can be witnessed in FIG. 14, the bore-sight of the antenna was initially positioned to point at J based upon calculations using the entered longitude and latitude as well as the measured compass reading. The rough-tune search automatically seeks the bore-sight position giving the best signal for the selected sub-carrier audio frequency which as shown in FIG. 14 is at point K for purposes of illustration. It is to be expressly understood that the teachings of the present invention are not limited to a spiral search pattern and that other search patterns could be used.

Fine-Tune Search Pattern

In FIG. 17, the method used for fine tuning is illustrated. The bore-sight of the antenna 10 is roughly tuned to point K in FIG. 17. K forms the center of a rectangular window which has a dimension of 2n (width) by 2m (length). K is located in the center of the rectangle 1700. The width of the window could either be the Az or E direction.

FIG. 18 sets forth the details of the fine tune stage 1550. This stage is entered at start 1800 and then the first stage 1804 is entered. The antenna is directed to align the bore-sight at point D1 which is on the edge of the window 1700. The antenna is scanned along a first line from D1 through K to D2 which is the opposing edge of the formed window. This occurs in stage 1808. One hundred data readings are taken between D1 and D2 which is determined by stage 1810. This is a significant increase in the taking of data samples when compared to the rough-tune. The scanning continues until the edge of the window D2 is reached in stage 1814. Each data reading is read and stored in stage 1818. When 100 readings are taken, stage 1820 is entered. The antenna movement is stopped.

Stage 1530, which is illustrated in FIG. 16, is reentered. If no satellite is found in stage 1824, stage 1828 is entered which causes the antenna to move back to point K. Stage 1830 is then entered indicating that the fine tuning has failed.

However, if the target satellite is found, stage 1840 is entered. Assume, for purposes of illustration that the detected peak is located at point L. The bore-sight of the satellite dish is moved to point L on line D1-D2 in stage 1840. The bore-sight of the antenna is then moved to E1 in stage 1844. The bore-sight of the antenna is then scanned on line E1-E2 which is perpendicular to line D1-D2. This occurs in stage 1850. One hundred samples are taken as the antenna moves from point E1 to point E2. In stage 1854 the readings taken are stored in stage 1858 until the opposing edge E2 of the window is detected in stage 1860.

Again, the antenna is stopped in stage 1864 and stage 1530 is reentered to ascertain the peak. If the peak is not found, then no satellite is found in stage 1870 causing the system to enter stage 1874 which moves the antenna back to starting point K and then into stage 1878 indicating that the fine tune failed. However, assume that a peak was located at point M. The bore-sight of the satellite dish is then moved so that it aligns with point M in stage 1874. Stage 1880 is entered indicating that the fine tune has worked and stage 1550 is exited. At this point, and with respect to FIG. 17, the precise location of the satellite has been obtained.

Returning to FIG. 15, stage 1550 is exited and stage 1560 is entered indicating that the fine tune has worked. If the fine tune has not worked, as indicated by stages 1830 and 1878 of FIG. 18, then stage 1538 is reentered. However, if the fine tune works, then stage 1570 is entered and the satellite is found. The executed search 760 of FIG. 7 is now exited.

It is to be understood that while the spiral search is used for the rough-tune and the rectangular search is used for the fine-tune, the system would still operate if the two were reversed in order or if two successive spiral searches or if any two successive rectangular searches were used.

Resynchronize

Returning now to FIG. 7, stage 770 is entered. When the target satellite is found, stage 780 is entered. This is an important part of the present invention. Initially the system calculated the position of the target satellite in stage 730. This initial calculation assumed a physical zero position for $C_{az}$ and $C_{el}$. The term "physical zero" means that it starts at a predetermined fixed count relative to the stowed position. However, as can be witnessed with respect to FIGS. 14 and 17, the calculated position J of the target satellite did not correlate to the final actual peaked position M. Hence, in stage 780, the initial physical zero values for $C_{az}$ and $C_{el}$ are updated by the microprocessor 200 so that the calculation occurring in stage 730 would now precisely calculate point M. This is an important feature since the user of the system can re-stow the antenna and then upon re-initiation of the system, the system will rapidly, in stage 730, fine tune directly to the satellite. This is true if the RV has not moved to a new position.

Stage 784 is then entered wherein the positions of all of the remaining satellites are calculated. These calculations occur in the same fashion as the calculations in stage 730 occurred except for the relative location of the remaining satellites. Stage 790 is then entered wherein the receiver 60 tunes the system to the precise satellite and transponder selected by the user. In other words, the target satellite, although utilized to tune the satellite dish antenna to the satellites in the Clarke belt, is transparent to the user of the system who desires only to see the satellite and transponder that he has selected. Stage 794 is then entered and the search stage 370 is over with.

Returning to FIG. 3, the picture is displayed in stage 390. It is to be expressly understood that the TVRO system of the present invention could also be used at a fixed "at-home" installation.

Adjustment of Search Parameters

In FIG. 19, the user of the present invention has complete control over the search parameters for the rough-tune and fine-tune patterns as discussed above. FIG. 19 sets forth the search parameter menu displayed on TV 70. The menu 1900 controls all of the operational parameters.

For example, for the rough-tune, in FIG. 19, the azimuth portion of the spiral corresponds to 60 counts and the elevation portion of the spiral corresponds to 90 counts. One degree in the azimuth direction contains 10 counts. I=14 which corresponds to the scan steps. The number of data samples taken for each of the scan steps is set to 12. Any of these parameters can be suitably adjusted by the user within a range of values.

Likewise, the fine tune has set the azimuth fine counts equal to 50 and the elevation fine window counts equal to 75. Elevation direction is 15 counts per degree on average. The azimuth fine steps are 100 and the elevation fine steps are 150. Again, any suitable range could be selected by the user. Finally, the signal threshold is set to 3.

Polarity Adjustment

Figure 22:
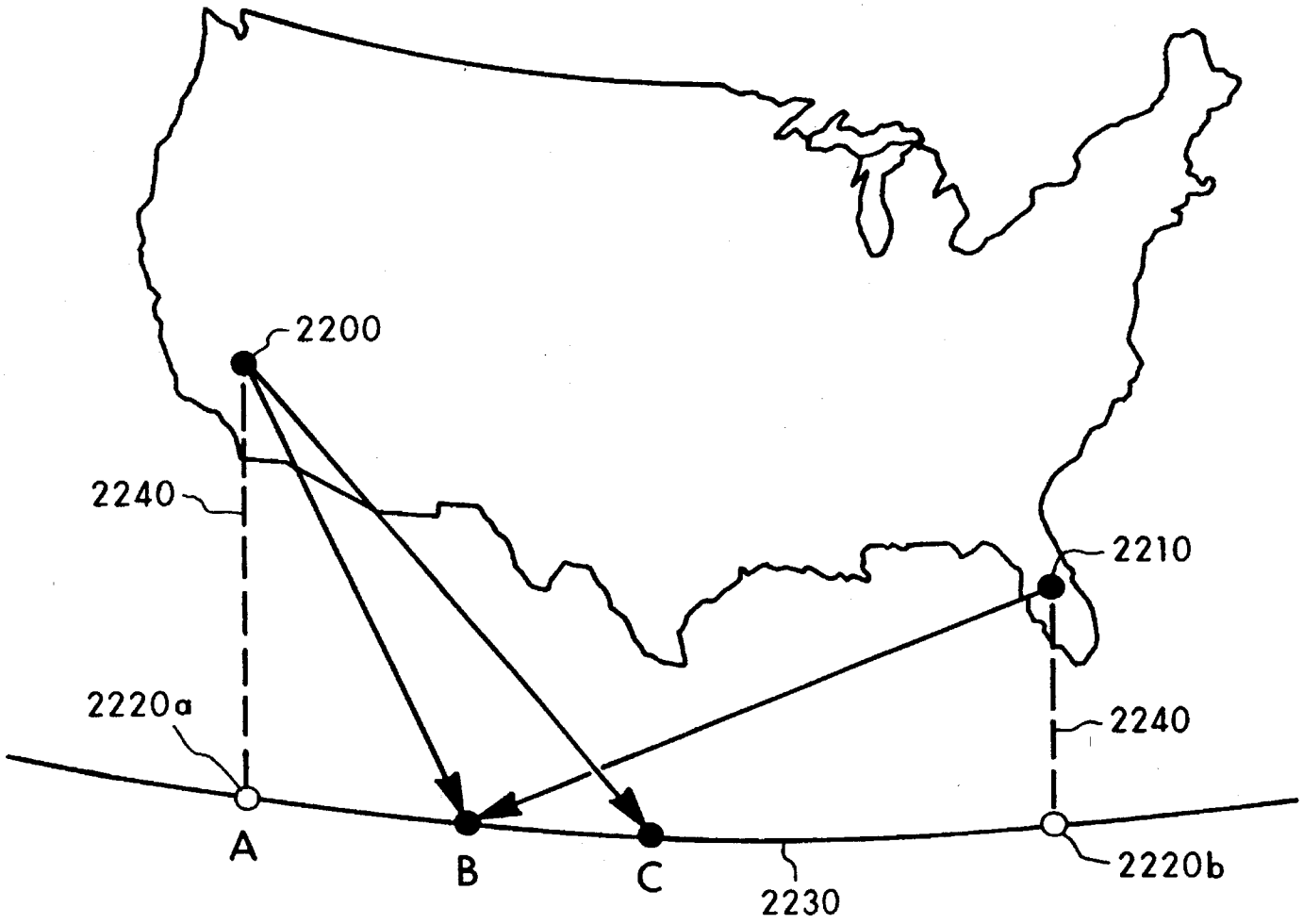
FIG. 22 sets forth two possible locations of the antenna of the present invention requiring polarity adjustments.
Figure 23:
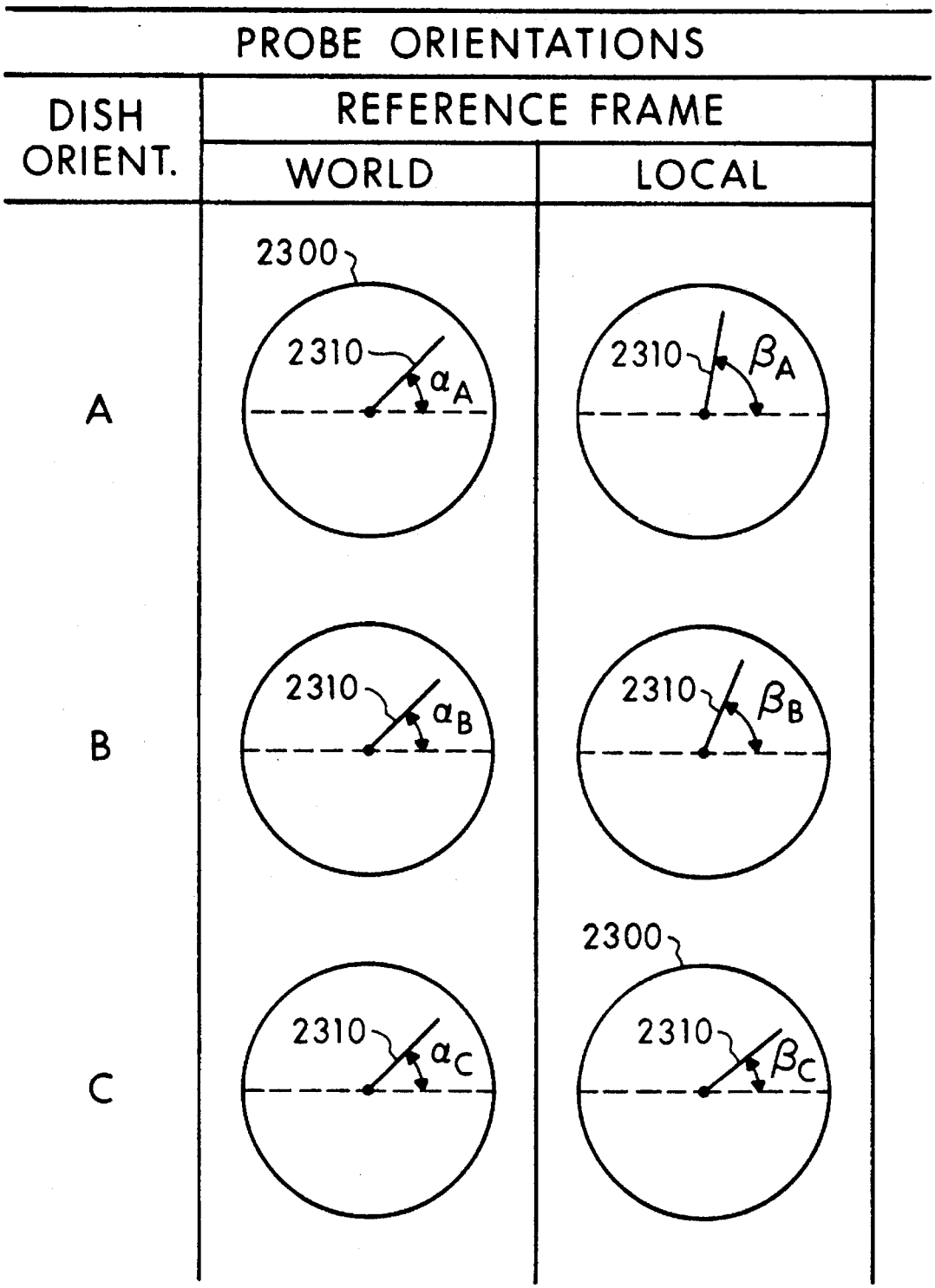
FIG. 23 illustrates the adjustment of the probe of the present invention for proper polarity.

As a final feature of the present invention, this receiver is capable of automatically compensating for variations in the polarity settings. This is shown in FIGS. 22 and 23. As the vehicle moves, for example, across the United States, the polarity setting of the polarotor probe from one location to the other location may vary. This would especially be true if the vehicle would move from California 2200 to Florida 2210 which would represent the extremes. This represents an option which may be provided in the receiver of the present invention. This may occur, for example, prior to entering search 350 and may be activated as a separate selection in menu 400 as shown as item 8 in FIG. 4. The polarity is adjusted so that when the search stage 350 is entered, a maximum audio signal will be detected. If the polarity is improperly adjusted, then the true peak signal will not be detected in either the rough-tune or fine-tune stages.

In order to compensate for the polarity setting, a reference satellite 2220 is assumed to exist in the Clarke Belt 2230. The reference satelite 2220 is always assumed to be due south 2240 of the vehicle. Hence, the following two values of azimuth and elevation are true for the referenced satellite:

$Az_r$=180°

$El_r$=a value to be calculated

As fully set forth in the foregoing sections of this application, the calculation of the azimuth and elevation angles for the target satellite have been determined. Hence, the target satellite has the azimuth Az and the elevation El angles. When the system performs the search it calculates the polarity for the target satellite based upon the initial search postion which assures a successful search. After the search is completed the polarities are then calculated for the other satellite locations.

In order to determine the rotation of the system from the reference satellite so as to determine the adjustment to the polararity, the following two calculations are used:

$\Delta Az = Az_r - Az = 180° - Az$ $\Delta El = El_r - El$

Total rotation $= T_r = \Delta Az + \Delta El$

New polarity settings are set forth in the following two formulas:

$$P_v = P_{vr} + T_r$$

$$P_h = P_v - 90°$$

Where:

$P_v$=New Vertical Polarity $P_{vr}$=Reference Vertical Polarity $T_r$=Total Rotation $P_h$=New Horizontal Polarity The value of $P_{vr}$ is that angle that the system of the present invention would lave for the vertical polarity of the target satellite if the system was placed at the same longitude as the target satellite. In the present embodiment, the reference value $P_{vr}$ is the same for all satellites in the Clarke Belt and is 170°.

In FIG. 23, an example of calculating the probe 2310 orientation is set forth. Assume satellites A, B, & C are located in the Clarke Belt 2230 of FIG. 22. Satellite A (i.e., 2220*a*) is the reference satellite and is due South of location 2200. Satellite B is East of satellite A and satellite C is East of satellite B. In FIG. 23, the dish antenna 2300 has a conventional polorator probe 2310 which must be oriented to allow the antenna to receive signals of either horizontal or vertical polarity. In the chart of FIG. 23, the dish is initially pointed at satellite A. The probe 2310 is oriented to match the vertical polarity $P_v$ which is $\alpha_A$. Under the teachings of the present invention, $\beta_A$ is used as the reference angle. As indicated above, the vertical polarity, $\alpha_A$ is always 170°. The horizontal polarity $P_h$, $\beta_A$, is calculated as set forth above. When the dish 2200 is pointed at satellite B, the vertical polarities match so that $\alpha_A$ equals $\beta_B$. However, the horizonal polarity $\beta_A$ and $\beta_B$ do not equal. Hence, and as set forth above, the difference is calculated as $\Delta\beta = \beta_B - \beta_A$. When the dish antenna is pointed at satellite C which is east of satellite B, again, the vertical polarities match so that $\alpha_A = \alpha_B = \alpha_C$. However, $\beta_A$, $\beta_B$, and $\beta_C$ do not equal. Hence, the difference, $\Delta\beta = \beta_C - \beta_A$.

The present invention is not to be limited by the description of the above exemplary embodiment. The configuration of the system of the present invention encompasses other embodiments and variations as well as applied in a number of differing applications within the scope of the present inventive concept as set forth in the following claims.

We claim:

1. An automated method for positioning a satellite dish antenna mounted on the roof of a parked vehicle in order to receive signals from a plurality of satellites located in a geosynchronous belt, a receiver in the vehicle connected to receive signals from the satellite dish antenna, said automated method comprising:

(a) moving the satellite dish antenna in the azimuth and elevation directions to an initial search position in response to signals from the receiver, and (b) with the satellite dish antenna in the initial search position, moving the satellite dish antenna to reading positions at intervals in predetermined search patterns in the azimuth and elevation directions until detecting in the receiver a signal peak reading for a selected audio subcarrier frequency in a selected channel of a target satellite located in the geosynchronous belt, the selected audio subcarrier frequency being unique in that the frequency of the selected audio subcarrier is not present in the corresponding selected channels of satellites near the target satellite.

2. The automatic method of claim 1 further comprising the steps of:

(d) providing a reference satellite location, and (e) adjusting the polarity of the satellite dish antenna based upon the location of the parked vehicle with respect to the reference satellite location.

3. The automated method of claim 1 in which the step of moving the satellite dish antenna to the initial position comprises the steps of:

(a1) generating magnetic direction signal from a magnetic compass mounted on the satellite dish antenna, (a2) storing a plurality of latitude and longitude coordinates correlated to a plurality of geographical locations, (a3) displaying the plurality of geographical locations, (a4) providing one latitude and longitude coordinate in response to an input signal based upon the manual selection of one geographical location in response to said step of displaying, and (a5) determining the initial search position based upon the magnetic direction signal and the one latitude and longitude coordinate.

4. The automated method of claim 1 further comprising the steps of:

(c) calculating in the receiver the azimuth and elevation positions of all remaining satellites in the geosynchronous belt based upon the position of the satellite dish antenna upon detecting said signal peak, and (d) after the position of the satellite antenna is determined in step (c), substituting the aforesaid position for the initial position so that the time required to perform the next predetermined search pattern is reduced.

5. The method of claim 1 wherein the step of moving the satellite dish antenna to the reading positions of intervals in the predetermined search pattern comprises the steps of:

(b1) moving the satellite dish antenna in a first linear direction a first given amount, (b2) moving the satellite antenna in a second linear direction a second given amount, the second linear direction being perpendicular to the first linear direction, (b3) increasing the first given amount by a first constant value and moving the satellite antenna in a direction opposite said first linear direction, (b4) increasing the second given amount by a second constant value and moving the satellite antenna in a direction opposite said second linear direction, (b5) increasing the first given amount by the first constant value and moving the satellite antenna in the first linear direction, (b6) increasing the second given amount by the second constant value and moving the satellite antenna in the second linear direction, and (b7) repeating steps (b3) through (b6) until the signal peak is detected.

6. The method of claim 1 wherein the step of moving the satellite dish antenna to the reading positions at intervals in the predetermined search pattern comprises the steps of:

(b1) forming a rectangular search window with the initial search position located in the center of the rectangular search window, (b2) moving the satellite antenna in a first line from one edge of the formed window through the initial search position to the opposing edge of the formed window, (b3) detecting the position of the peak signal along the first line, and (b4) moving the satellite antenna in a second line from one edge of the formed window through the detected peak position to the opposing edge of the formed window, the second line being perpendicular to the first line.

7. A method for positioning a satellite dish antenna mounted on a parked vehicle in order to receive signals from a plurality of satellites located in a geosynchronous belt, a receiver in the vehicle connected to receive signals from the satellite dish antenna and an electronic compass connected to the mount of the satellite dish antenna for generating a direction signal corresponding to the magnetic direction of the satellite dish antenna, said method comprising:

(a) automatically delivering the direction signal from the electronic compass to the receiver at the request of the receiver, (b) manually entering the approximate latitude and longitude values of said parked vehicle into the receiver, (c) determining in the receiver an initial search position for the satellite dish antenna based upon said entered latitude and longitude values and the direction signal, (d) moving the satellite dish antenna in the azimuth and elevation directions to the initial search position in response to the aforesaid step of determination, and (e) with the satellite dish antenna in the initial search position, moving the satellite dish antenna to reading positions at intervals in at least one predetermined search pattern in the azimuth and elevation directions until detecting in the receiver a signal peak reading for a selected audio subcarrier frequency in a selected channel of a target satellite located in the geosynchronous belt, the selected audio subcarrier frequency being unique in that the frequency of the selected audio subcarrier is not present in the corresponding selected channels of satellites near the target satellite.

8. The method of claim 7 further comprising the steps of:

(g) providing a reference satellite location, and (h) adjusting the polarity of the satellite dish antenna based upon the location of the parked vehicle to the reference satellite location.

9. The automated method of claim 7 in which the step of manually entering the approximate latitude and longitude values comprises the steps of:

(b1) storing a plurality of latitude and longitude coordinates correlated to a plurality of geographical locations, (b2) displaying the plurality of geographical locations, (b3) providing one latitude and longitude coordinate in response to an input signal based upon the manual selection of one geographical location in response to said step of displaying, and (b4) determining the initial search position based upon the magnetic direction signal and the one latitude and longitude coordinate.

10. The automated method of claim 7 further comprising the steps of:

(f) calculating in the receiver the azimuth and elevation positions of all remaining satellites in the geosynchronous belt based upon the position of the satellite dish antenna upon detecting said signal peak, and (g) after the position of the satellite antenna is determined in step (f), substituting the aforesaid position for the initial position so that the time required to perform the next at least one predetermined search pattern is reduced.

11. The method of claim 7 herein the step of moving the satellite dish antenna to the reading positions at intervals in at least one predetermined search pattern comprises the steps of:

(e1) moving the satellite dish antenna in a first linear direction a first given amount, (e2) moving the satellite antenna in a second linear direction a second given amount, the second linear direction being perpendicular to the first linear direction, (e3) increasing the first given amount by a first constant value and moving the satellite antenna in a direction opposite said first linear direction, (e4) increasing the second given amount by a second constant value and moving the satellite antenna in a direction opposite said second linear direction, (e5) increasing the first given amount by the first constant value and moving the satellite antenna in the first linear direction, (e6) increasing the second given amount by the second constant value and moving the satellite antenna in the second linear direction, and (e7) repeating steps (e3) through (e6) until the first signal peak is detected.

12. The method of claim 7 wherein the step of moving the satellite dish antenna to the reading positions at intervals in at least one predetermined search pattern comprises the steps of:

(e1) forming a rectangular search window with the initial search position located in the center of the rectangular search window, (e2) moving the satellite antenna in a first line from one edge of the formed window through the initial search position to the opposing edge of the formed window, (e3) detecting the position of a peak signal along the first line, and (e4) moving the satellite antenna in a second line from one edge of the formed window through the detected peak position to the opposing edge of the formed window, the second line being perpendicular to the first line.

13. A method for positioning a satellite dish antenna mounted on a parked vehicle in order to receive signals from a plurality of satellites located in a geosynchronous belt, a receiver connected to receive signals from the satellite dish antenna and an electronic compass connected to the satellite dish antenna for generating a direction signal corresponding to the magnetic direction of the satellite dish antenna, said method comprising:

(a) automatically delivering the direction signal from the electronic compass to the receiver at the request of the receiver, (b) manually entering the approximate latitude and longitude values of said parked vehicle into the receiver, (c) determining in the receiver an initial search position for the satellite dish antenna based upon said entered latitude and longitude values and the direction signal, (d) moving the satellite dish antenna in azimuth and elevation directions to the initial search position in response to the aforesaid step of determination, (e) with the satellite dish antenna in the initial search position, moving the satellite dish antenna to reading positions at intervals in a first predetermined search pattern until obtaining a rough-tune position corresponding to the detection by the receiver of a first signal peak reading for a selected audio subcarrier frequency in a selected channel of a target satellite located in the geosynchronous belt, the selected audio subcarrier frequency being unique in that the frequency of the selected audio subcarrier is not present in corresponding selected channels of satellites near the target satellite, and (f) with the satellite dish antenna in the rough-tune position, moving the satellite dish antenna to reading positions at intervals in a second predetermined search pattern until obtaining a fine-tune position corresponding to the detection of a second signal peak reading for the selected audio subcarrier frequency.

14. The method of claim 13 wherein the step of moving the satellite dish antenna to the reading positions at intervals in the first predetermined search pattern comprises the steps of:

(e1) moving the satellite dish antenna in a first linear direction a first given amount, (e2) moving the satellite antenna in a second linear direction a second given amount, the second linear direction being perpendicular to the first linear direction, (e3) increasing the first given amount by a first constant value and moving the satellite antenna in a direction opposite said first linear direction, (e4) increasing the second given amount by a second constant value and moving the satellite antenna in a direction opposite said second linear direction, (e5) increasing the first given amount by the first constant value and moving the satellite antenna in the first linear direction, (e6) increasing the second given amount by the second constant value and moving the satellite antenna in the second linear direction, and (e7) repeating steps (e3) through (e6) until the first signal peak is detected.

15. The method of claim 13 wherein the step of moving the satellite dish antenna to the reading positions at intervals in the second predetermined search pattern comprises the steps of:

(f1) forming a rectangular search window with the rough-tune position located in the center of the rectangular search window, (f2) moving the satellite antenna in a first line from one edge of the formed window through the rough-tune position to the opposing edge of the formed window, (f3) detecting the position of a peak signal along the first line, and (f4) moving the satellite antenna in a second line from one edge of the formed window through the detected peak position to the opposing edge of the formed window, the second line being perpendicular to the first line.

16. The method of claim 13 further comprising the steps of:

(h) providing a reference satellite location, and (i) adjusting the polarity of the satellite dish antenna based on the location of the parked vehicle to the reference satellite location.

17. The method of claim 13 wherein the step of determining an initial search position additionally comprises the step of:

after determining the fine-tune position in step (f), substituting the fine-tune position for the initial search position so that the time required to perform the next rough-tune and fine-tune searches is reduced.

18. The method of claim 13 wherein the step of moving the satellite dish antenna to the initial search position includes the step of raising the satellite dish antenna in the elevation direction a predetermined distance before moving the satellite dish antenna in the azimuth direction so as to avoid hitting other objects on the roof of the vehicle.

19. An automatic method for positioning a satellite dish antenna mounted on a parked vehicle in order to receive signals from a plurality of satellites located in a geosynchronous belt, a receiver connected to receive signals from the satellite dish antenna and an electronic compass connected to the satellite dish antenna for generating a direction signal corresponding to the magnetic direction of the satellite dish antenna, and motors moving the satellite dish antenna from a stowed position to a receiving position, said automatic method comprising:

(a) activating the motors to move the satellite dish antenna in azimuth and elevation directions from the stowed position to an initial search position in response to signals from the receiver, and (b) with the satellite dish antenna in the initial search position, activating the motors to move the satellite dish antenna to reading positions at intervals in a predetermined search pattern until detecting in the receiver a signal peak reading for a selected audio subcarrier frequency in a selected channel of a target satellite located in the geosynchronous belt.

20. The automatic method of claim 19 further comprising the steps of:

(c) calculating in the receiver the azimuth and elevation positions of all remaining satellites in the geosynchronous belt based upon the position of the satellite dish antenna upon detecting said signal peak, and (d) substituting the aforesaid position for the initial position in step (a) so that the time required to perform the search of step (b) is reduced as long as the vehicle is parked and whenever the satellite dish antenna is restowed.

21. An automatic method for positioning a satellite dish antenna mounted on a parked vehicle in order to receive signals from a plurality of satellites located in a geosynchronous belt, a receiver connected to receive signals from the satellite dish antenna and an electronic compass connected to the satellite dish antenna for generating a direction signal corresponding to the magnetic direction of the satellite dish antenna, and motors moving the satellite dish antenna from a stowed position to a receiving position, said automatic method comprising:

(a) activating the motors to move the satellite dish antenna in azimuth and elevation directions from the stowed position to an initial search position in response to signals from the receiver by first raising the satellite dish antenna a predetermined amount in the elevation direction, and (b) with the satellite dish antenna in the initial search position, activating the motors to move the satellite dish antenna to reading positions of intervals in a predetermined search pattern until detecting in the receiver a signal peak reading for a selected audio subcarrier frequency in a selected channel of a target satellite located in the geosynchronous belt.

22. An automatic method for positioning a satellite dish antenna mounted on a parked vehicle in order to receive signals from a plurality of satellites located in a geosynchronous belt, a receiver connected to receive signals from the satellite dish antenna and an electronic compass connected to the satellite dish antenna for generating a direction signal corresponding to the magnetic direction of the satellite dish antenna, and motors moving the satellite dish antenna from a stowed position to a receiving position, said automatic method comprising:

(a) activating the motors to move the satellite dish antenna in azimuth and elevation directions from the stowed position to an initial search position in response to signals from the receiver, and (b) with the satellite dish antenna in the initial search position, activating the motors to move the satellite dish antenna to reading positions at intervals in a predetermined search pattern until detecting in the receiver a signal peak for a selected audio subcarrier frequency in a selected channel of a target satellite located in the geosynchronous belt.

23. The automatic method of claim 22 further comprising the steps of:

(c) calculating in the receiver the azimuth and elevation positions of all remaining satellites in the geosynchronous belt based upon the position of the satellite dish antenna upon detecting said signal peak, (d) providing a reference satellite location, and (e) adjusting the polarity of the satellite dish antenna based on the location of the parked vehicle to the reference satellite location.

24. An automatic method for positioning a satellite dish antenna mounted on a parked vehicle in order to receive signals from a plurality of satellites located in a geosynchronous belt, a receiver connected to receive signals from the satellite dish antenna and an electronic compass connected to the satellite dish antenna for generating a direction signal corresponding to the magnetic direction of the satellite dish antenna, and motors moving the satellite dish antenna from a stowed position to a receiving position, said automatic method comprising:

(a) activating the motors to move the satellite dish antenna in azimuth and elevation directions from the stowed position to an initial search position in response to signals from the receiver by first raising the satellite dish antenna a predetermined amount in the elevation direction, and (b) with the satellite dish antenna in the initial search position, activating the motors to move the satellite dish antenna to reading positions at intervals in a predetermined search pattern until detecting in the receiver a signal peak for a selected audio subcarrier frequency in a selected channel of a target satellite located in the geosynchronous belt, the selected audio subcarrier frequency being unique in that the frequency of the selected audio subcarrier is not present in corresponding selected channels of satellites near the target satellite.

25. The automatic method of claim 24 further comprising the steps of:

(c) calculating in the receiver the azimuth and elevation positions of all remaining satellites in the geosynchronous belt based upon the position of the satellite dish antenna upon detecting said signal peak, (d) substituting the aforesaid position for the initial position in step (a) so that the time required to perform the search of step (b) is reduced as long as the vehicle is parked and whenever the satellite dish antenna is restowed, (e) providing a reference satellite location, and (f) adjusting the polarity of the satellite dish antenna based on the location of the parked vehicle to the reference satellite location.

* * * * *